US008177076B2

(12) United States Patent
Rataiczak, III et al.

(10) Patent No.: US 8,177,076 B2
(45) Date of Patent: May 15, 2012

(54) MERCHANDISING SYSTEM

(75) Inventors: James J. Rataiczak, III, Chesterland, OH (US); Paul A. Mueller, Wadsworth, OH (US); Daniel J. Kump, Gates Mills, OH (US); Raymond J. Fritz, Northfield, OH (US); Richard Alan Williams, Akron, OH (US); Wallace D. Tiller, Jr., Stow, OH (US); Daniel Edward Kustra, Parma, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 404 days.

(21) Appl. No.: 11/809,862

(22) Filed: Jun. 1, 2007

(65) Prior Publication Data

US 2008/0017598 A1 Jan. 24, 2008

Related U.S. Application Data

(63) Continuation-in-part of application No. 11/356,398, filed on Feb. 16, 2006, now Pat. No. 7,971,735.

(51) Int. Cl.
*A47F 7/00* (2006.01)

(52) U.S. Cl. ..... 211/59.3

(58) Field of Classification Search ..... 211/59.2, 211/59.3, 184, 189, 175
See application file for complete search history.

(56) References Cited

U.S. PATENT DOCUMENTS

| | | | |
|---|---|---|---|
| 1,971,749 | A | 8/1934 | Hamilton |
| 2,079,754 | A | 5/1937 | Waxgiser |
| 2,652,154 | A | 9/1953 | Stevens |
| 2,678,045 | A | 5/1954 | Erhard |
| 3,038,067 | A | 6/1962 | Dench et al. |
| 3,161,295 | A | 12/1964 | Chesley |
| 3,308,961 | A | 3/1967 | Chesley |
| 3,452,899 | A | 7/1969 | Libberton |
| 3,751,129 | A | 8/1973 | Wright et al. |
| 3,814,490 | A | 6/1974 | Dean et al. |
| 3,868,021 | A | 2/1975 | Heinrich |
| 4,042,096 | A | 8/1977 | Smith |
| 4,106,668 | A | 8/1978 | Gebhardt et al. |
| 4,269,326 | A | 5/1981 | Delbrouck |
| 4,303,162 | A | 12/1981 | Suttles |
| 4,351,439 | A | 9/1982 | Taylor |
| 4,378,872 | A | 4/1983 | Brown |

(Continued)

FOREIGN PATENT DOCUMENTS

DE 28 25 724 12/1979

(Continued)

OTHER PUBLICATIONS

FFr Yellow Pages® 2003 Product Catalog, "Merchandising Ideas Made Easy for Every Retail Environment!", Cover p. 9-11, 48-49, 52-58, Back Cover.

*Primary Examiner* — Jennifer E. Novosad
(74) *Attorney, Agent, or Firm* — Fay Sharpe LLP

(57) ABSTRACT

A merchandising system includes an elongated mounting member selectively securable to an associated shelf. A cooperating member is received on the mounting member, wherein the cooperating member extends rearwardly over the associated shelf. The cooperating member includes an elongated body. An engaging element is mounted to the elongated body and is movable in relation thereto. The engaging element selectively contacts the mounting member in order to selectively secure the cooperating member to the mounting member.

12 Claims, 29 Drawing Sheets

U.S. PATENT DOCUMENTS

| | | | | |
|---|---|---|---|---|
| 4,488,653 | A | 12/1984 | Belokin | |
| 4,615,276 | A | 10/1986 | Garabedian | |
| 4,724,968 | A | 2/1988 | Wombacher | |
| 4,730,741 | A | 3/1988 | Jackle, III et al. | |
| 4,762,236 | A | 8/1988 | Jackle, III et al. | |
| 4,775,058 | A | 10/1988 | Yatsko | |
| 4,830,201 | A | 5/1989 | Breslow | |
| 4,907,707 | A | 3/1990 | Crum | |
| 5,111,942 | A | 5/1992 | Bernardin | |
| 5,161,704 | A | 11/1992 | Valiulis | |
| 5,190,186 | A | 3/1993 | Yablans et al. | |
| 5,203,463 | A | 4/1993 | Gold | |
| 5,255,802 | A | 10/1993 | Krinke et al. | |
| 5,325,792 | A * | 7/1994 | Mulloy | 108/28 |
| 5,341,945 | A | 8/1994 | Gibson et al. | |
| 5,351,839 | A | 10/1994 | Beeler et al. | |
| 5,390,802 | A | 2/1995 | Pappagallo et al. | |
| 5,450,969 | A | 9/1995 | Johnson et al. | |
| 5,469,976 | A | 11/1995 | Burchell | |
| 5,562,217 | A | 10/1996 | Salveson et al. | |
| 5,634,564 | A | 6/1997 | Spamer et al. | |
| 5,665,304 | A | 9/1997 | Heinen et al. | |
| 5,673,801 | A | 10/1997 | Markson | |
| 5,746,328 | A | 5/1998 | Beeler et al. | |
| 5,839,588 | A | 11/1998 | Hawkinson | |
| 6,041,720 | A | 3/2000 | Hardy | |
| 6,082,557 | A | 7/2000 | Leahy | |
| 6,129,218 | A | 10/2000 | Henry et al. | |
| 6,142,317 | A | 11/2000 | Merl | |
| 6,227,385 | B1 | 5/2001 | Nickerson | |
| 6,227,513 | B1 * | 5/2001 | Richard | 248/346.07 |
| 6,234,328 | B1 | 5/2001 | Mason | |
| 445,615 | A1 | 7/2001 | Burke | |
| 6,382,431 | B1 | 5/2002 | Burke | |
| 6,409,027 | B1 | 6/2002 | Chang et al. | |
| 6,409,028 | B2 | 6/2002 | Nickerson | |
| 6,464,089 | B1 | 10/2002 | Rankin, VI | |
| 6,484,891 | B2 | 11/2002 | Burke | |
| 6,527,127 | B2 | 3/2003 | Dumontet | |
| 6,533,131 | B2 | 3/2003 | Bada | |
| 472,411 | A1 | 4/2003 | Burke | |
| 6,598,754 | B2 * | 7/2003 | Weiler | 211/184 |
| 6,622,874 | B1 | 9/2003 | Hawkinson | |
| 6,655,536 | B2 | 12/2003 | Jo et al. | |
| 6,666,533 | B1 | 12/2003 | Stavros | |
| D485,699 | S | 1/2004 | Mueller et al. | |
| 6,772,888 | B2 | 8/2004 | Burke | |
| 2001/0002659 | A1 | 6/2001 | Bada | |
| 2001/0010302 | A1 | 8/2001 | Nickerson | |
| 2002/0108916 | A1 | 8/2002 | Nickerson | |
| 2002/0170866 | A1 | 11/2002 | Johnson et al. | |
| 2003/0057167 | A1 | 3/2003 | Johnson et al. | |
| 2003/0085187 | A1 | 5/2003 | Johnson et al. | |
| 2003/0141265 | A1 | 7/2003 | Jo et al. | |
| 2003/0217980 | A1 | 11/2003 | Johnson et al. | |
| 2005/0139560 | A1 * | 6/2005 | Whiteside et al. | 211/119.003 |

FOREIGN PATENT DOCUMENTS

| | | |
|---|---|---|
| EP | 270016 | 6/1988 |
| EP | 0 337 340 | 10/1989 |
| EP | 986980 | 3/2000 |
| FR | 2 526 338 | 5/1982 |
| FR | 2617385 | 1/1989 |
| FR | 2 724 098 | 3/1996 |
| GB | 2 027 339 | 2/1980 |
| GB | 2290077 | 12/1995 |
| JP | 59-218-113 | 12/1984 |
| SW | 412251 | 4/1966 |
| WO | WO 02/091885 | 11/2002 |

* cited by examiner

MERCHANDISING SYSTEM

This application is a continuation-in-part of application Ser. No. 11/356,398 which was filed on Feb. 16, 2006 now U.S. Pat. No. 7,971,735.

FIELD OF THE DISCLOSURE

The present disclosure generally relates to adjustable shelving systems. More particularly, it is pertinent to an adjustable shelving system for storing and displaying merchandise of a variety of shapes and sizes, and urging such merchandise towards the front of a shelf. The shelving system is configured to organize merchandise on the shelf into rows.

BACKGROUND OF THE DISCLOSURE

Shelving is used extensively for stocking and storing products or merchandise in a variety of stores. Many stores simply employ shelves on which merchandise is stocked. In such stores, if the shelves are not at eye level, it is difficult for the customer to see the items being displayed, if they are not located adjacent the front edge of the shelf. It is desirable for merchandise to be displayed at the front of the shelf so that the customer can see the merchandise and be induced to purchase such merchandise. Also, such shelves make it difficult to rotate product, i.e., move the older stock to the front of the shelf and position newer stock behind the older stock. Rotating products is an important consideration, if the goods are perishable or are subject to becoming stale.

Numerous forward feed devices have been proposed to automatically move an item forward on a shelf, as the item before it is removed. These devices generally fall into one of three categories. The first category includes inclined tracks, which rely on gravity to feed, slide or roll products forward. A second category employs conveyor belts, which still use gravity to effect forward movement. A third category, which has become popular in recent years, uses spring biased paddles, in a pusher system to feed the product forward on a horizontally oriented shelf. Such pusher systems have been found useful for a variety of merchandise.

Forward feed devices are usually associated with divider walls. Normally, a divider wall is located on either side of a pusher, mounted on a track, (i.e., a pusher system), so as to maintain the merchandise in rows. In certain designs, both the pusher system and the divider wall are mounted to at least a front rail or front mounting member of the merchandising system, in order to allow a proper spacing of the pusher tracks and the divider walls on a shelf. In some known systems, the divider walls are separate from the pusher tracks. In others, the divider walls and the pusher tracks are of one piece. In either case, the divider walls and pusher tracks are, in some designs, slidably mounted on the front rail or mounting member. In other designs, one or both are fixedly mounted in relation to the front rail. In still other designs, both a front rail and a rear rail are employed and one or both of the pusher tracks and the divider walls are either fixedly secured to one or both of the front rail and the rear rail, or slidably mounted thereon.

Problems remain, however, with both the forward feed devices and the divider walls. As to the forward feed devices, almost universally today these are made from some type of plastic in an injection molding operation. However, the moldings are fairly complex and, thus, the die to make them is complicated and expensive. It would be desirable to develop a track of a simple design which would be easier to mold and yet have sufficient rigidity to resist the stresses and strains imposed on the track during use. With regard to the divider walls, these are normally of a single width. That width, however, may be too wide for certain thin merchandise items offered for sale, such as a row of tooth brushes or small bottles of paint for model kits, such as cars, airplanes, boats and the like.

Another difficulty with forward feed devices is that the current devices are not adapted for use in connection with wide products, such as frozen food packages sold in grocery stores or the like. Moreover, the current designs of dividers and tracks do not allow such dividers or tracks to be selectively locked to a mounting member, such as a front rail, or movable in relation to the mounting member. Nor are the current dividers and tracks provided with resiliently biased engaging elements for engaging a suitably shaped portion of the mounting member. It would be advantageous to have dividers and tracks that can be selectively locked to the mounting member or movable in relation thereto, via the simple engagement and disengagement of locking elements which are accessible from the front of the shelf. In this way, if it is desired to shift the divider or the track laterally in relation to the rail, the locking element can be disengaged and the divider or track can be shifted. It is particularly advantageous to be able to move the track without having to unload the products being held on the track, before the track can be moved.

Unloading of the products held on the track is greatly disadvantageous from the standpoint that it makes the shifting of the track along the rail a time consuming chore for store personnel. It should be appreciated that with the weight of the products on the track, it is quite difficult for store personnel to move the track laterally. This is due to the friction generated between the track and the shelf supporting it during any attempt to move the track because of the weight of product, when coupled with any locking feature of the track.

Therefore, it would be beneficial to store personnel if they could move a track (or a divider, or both) in a selective fashion without having to remove all the products which are held on the track. At the same time, it is beneficial to positively lock either the divider or the track, or both, to the rail when merchandise has been correctly loaded on the track, usually in a row, and the dividers are adequately spaced apart to accommodate the merchandise. In other words, it is desirable to prevent inadvertent movement of at least the dividers, if not also the tracks, during normal shopping activity by consumers. Dividers in particular are sometimes shifted sideways when round containers are pushed forward on tracks. It is said that the dividers "walk." It is desirable to retard or prevent such movement. However, it is also advantageous to allow store personnel to adjust the locations of at least the tracks, if not also the dividers, on a rail without being forced to unload the tracks before being able to move them.

Finally, it would be advantageous to provide a mechanism for limiting the rearward movement of a pusher paddle on a track so that store personnel cannot fill a row of high value product deeper onto a shelf than store management wishes. For example, for certain high value items, such as expensive perfumes, packages of razor blades, or the like, store management may wish to stock no more than three or four containers of the product on a shelf, so that any theft of product from that shelf is immediately obvious. Moreover, if the number of high value items available on a shelf at any one time is minimized, but yet at least one item is available, it will deter sweeping of the shelf because only a limited amount of items could be taken by a potential thief at any one time.

Accordingly, it has been considered desirable to develop a new and improved merchandising system which would over-come the foregoing difficulties and others, while providing better and more advantageous overall results.

SUMMARY OF THE DISCLOSURE

According to one aspect of the present disclosure, a merchandising system comprises an elongated mounting member selectively securable to an associated shelf. A cooperating member is received on the mounting member, wherein the cooperating member extends rearwardly over the associated shelf. The cooperating member comprises an elongated body. An engaging element is movably mounted to one of the cooperating member and the mounting member. The engaging element selectively contacts the other of the mounting member and the cooperating member in order to selectively retard movement between the cooperating member and the mounting member.

According to another aspect of the present disclosure, a merchandising assembly is provided. In accordance with this aspect of the disclosure, the merchandising assembly comprises an elongated mounting member selectively securable to an associated shelf and a track comprising an elongated body. A head portion is located at a forward end of the body. A pusher is selectively mounted on the body and is movable in relation to the head portion. A tongue protrudes forwardly from the head portion for contacting the mounting member when the track is mounted on the mounting member.

In accordance with a further aspect of the present disclosure, a merchandising system for a shelf is provided. In accordance with this aspect of the disclosure, the merchandising system comprises an elongated mounting member selectively securable to a front portion of an associated shelf and a cooperating member selectively mounted on the elongated mounting member. The cooperating member extends rearwardly over the associated shelf and comprises an elongated body. An engaging element is mounted to one of the cooperating member and the mounting member, and is moveable in relation thereto. The engaging element includes at least one protrusion which selectively contacts a surface of the other of the mounting member and the cooperating member to retard movement between the cooperating member and the mounting member.

According to still another aspect of the present disclosure, a merchandising assembly comprises an elongated mounting member selectively securable to an associated shelf and a cooperating member selectively connected to the mounting member. The cooperating member extends rearwardly over the associated shelf. The cooperating member comprises an elongated body including a first end and a second end. A first engaging surface including an engagement element is located adjacent the elongated body first end for contacting a surface of the mounting member. When the cooperating member is connected to the mounting member via the first engaging surface, the first engaging surface retards relative movement between the mounting member and the cooperating member. A second engaging surface is located adjacent the elongated body second end wherein when the cooperating member is connected to the mounting member via the second engaging surface, the second engaging surface does not retard relative movement between the cooperating member and the mounting member.

BRIEF DESCRIPTION OF THE DRAWINGS

The present disclosure may take form in certain parts and arrangements of parts, several embodiments of which will be described in detail in this specification and illustrated in the accompanying drawings which form a part hereof and wherein.

DETAILED DESCRIPTION OF THE PREFERRED EMBODIMENTS

Figure 1:
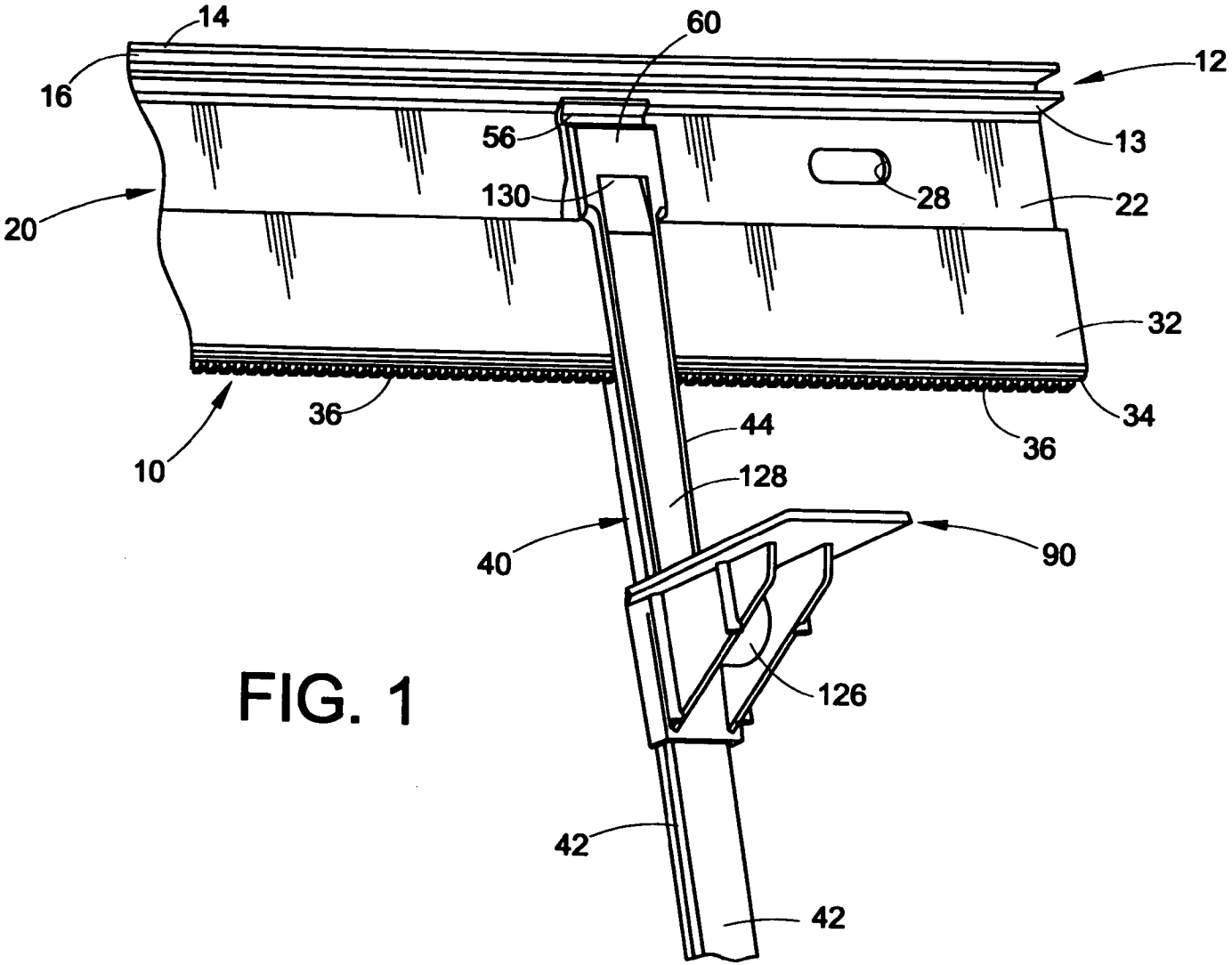
FIG. 1 is a rear perspective view of a merchandising system including a track mounted on a front rail, in accordance with a first embodiment of the present disclosure.

Referring now to the drawings, wherein the showings are for purposes of illustrating several preferred embodiments of the disclosure only, and not for purposes of limiting same, FIG. 1 illustrates a first embodiment of a merchandising system according to the present disclosure. In this embodiment, an elongated mounting member or front rail 10 includes a vertically oriented wall 12, which comprises a first section 14, a groove 16 and a second section 18. Also provided on the mounting member 10 is a horizontally oriented wall 20. Disposed in the horizontally oriented wall is a second groove 22. An aperture 28, positioned in the second groove 22, extends through the horizontally oriented wall 20. A suitable conventional fastener (not illustrated) can extend through the opening 28 so as to secure the mounting member in place on a subjacent shelf (not illustrated). Such a construction is shown in applicant's previously filed application Ser. No. 10/686,096 which is dated Oct. 14, 2003. That application is incorporated herein by reference, in its entirety. Moreover, applicant has also filed a related case, application Ser. No. 10/854,991 which is dated May 27, 2004. That application is also incorporated herein by reference, in its entirety.

As mentioned, the horizontally oriented wall 20 comprises the second groove 22, and a plateau-like section which includes a front face 30, a top face 32 and a back face 34. Located on the back face are a plurality of spaced teeth 36.

Figure 8:
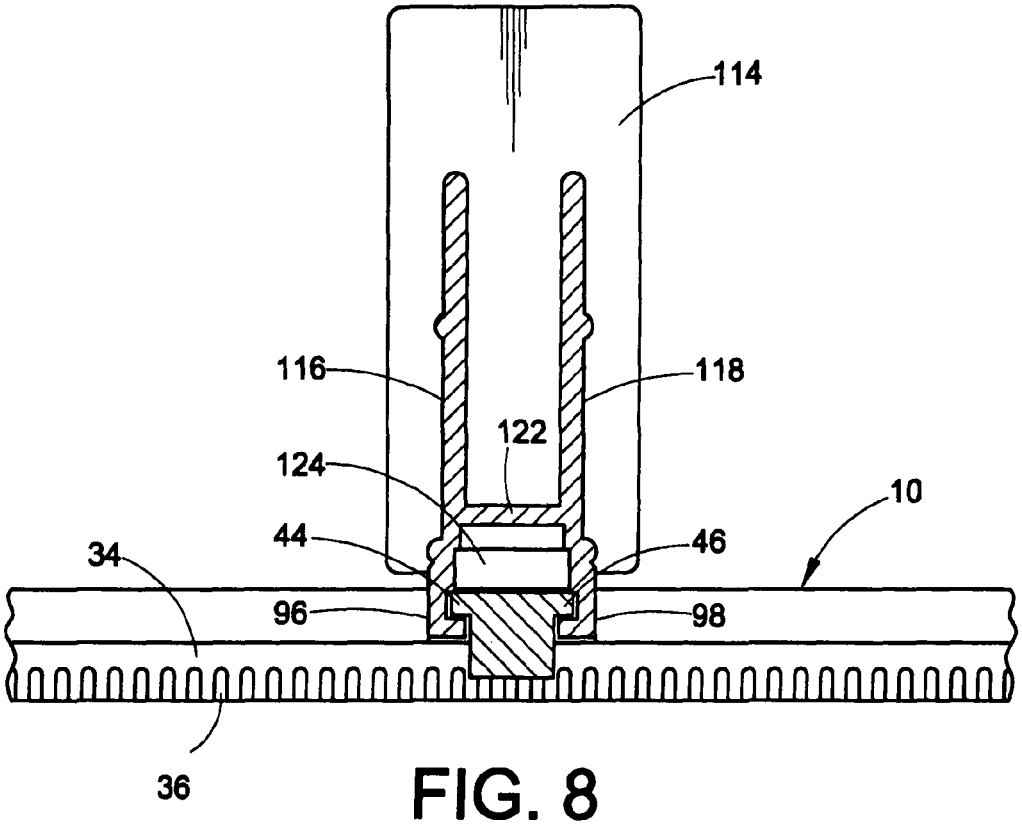
FIG. 8 is a rear elevational view, in partial cross section, of the merchandising system of FIG. 1.

A cooperating member, such as a pusher track 40 is selectively mounted on the front rail 10. The track 40 includes an elongated track body 42. Defined on the track body in this embodiment are a pair of oppositely extending rails 44 and 46. As is evident from FIG. 8, the track body 42 is solid in cross section. As can also be seen from the cross sectional view of FIG. 9, the track is solid in longitudinal section, along a longitudinal axis thereof. Having a solid rail is advantageous for a number of reasons. First, it makes the molding process for making the rail—from a suitable known thermoplastic material—easier than molding conventional tracks, which require a more complicated die. In addition, because the track is solid, rather than being hollow with cross braces, it can be made from a less expensive thermoplastic material than used for conventional tracks. Conventional track designs require a more rigid and hence more expensive thermoplastic material.

If desired, the track can be made via a gas-assisted injection molding process, in which a certain proportion of the thermoplastic material of the track is replaced by gas. Since less material is used, the cost of the track is reduced somewhat. Such a process allows the part to be somewhat lighter, while still preserving its inherent strength. With this design, the track also has a relatively lower coefficient of friction. The coefficient of friction of such a track is reduced somewhat because of the more porous track surface resulting from the gas-assisted injection molding process. With a more porous surface, there is less surface contact between the track on the one hand and merchandise or a pusher paddle on the other hand. Thus, merchandise supported by the track can more easily slide on the track, as can a pusher paddle.

Figure 3:
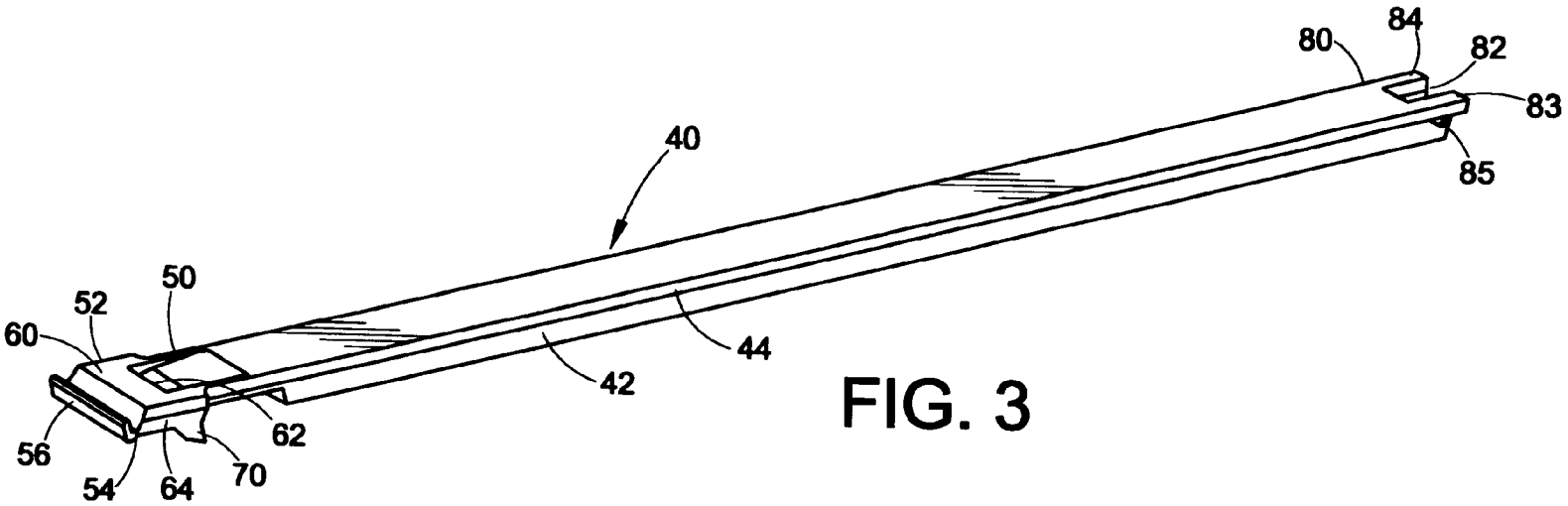
FIG. 3 is a top side perspective view of the track of FIG. 1.

With reference now to FIG. 3, the track includes a front end 50, which comprises a mounting head 52. The mounting head includes a front face 54. Protruding from the front face is a forwardly extending lip 56. As best seen in FIG. 1, the lip 56 is meant to engage the second section 18 of the front rail vertically oriented wall so as to correctly locate or position the track on the front rail and prevent any looseness or wobbling in the engagement between the track and the front rail.

Figure 2:
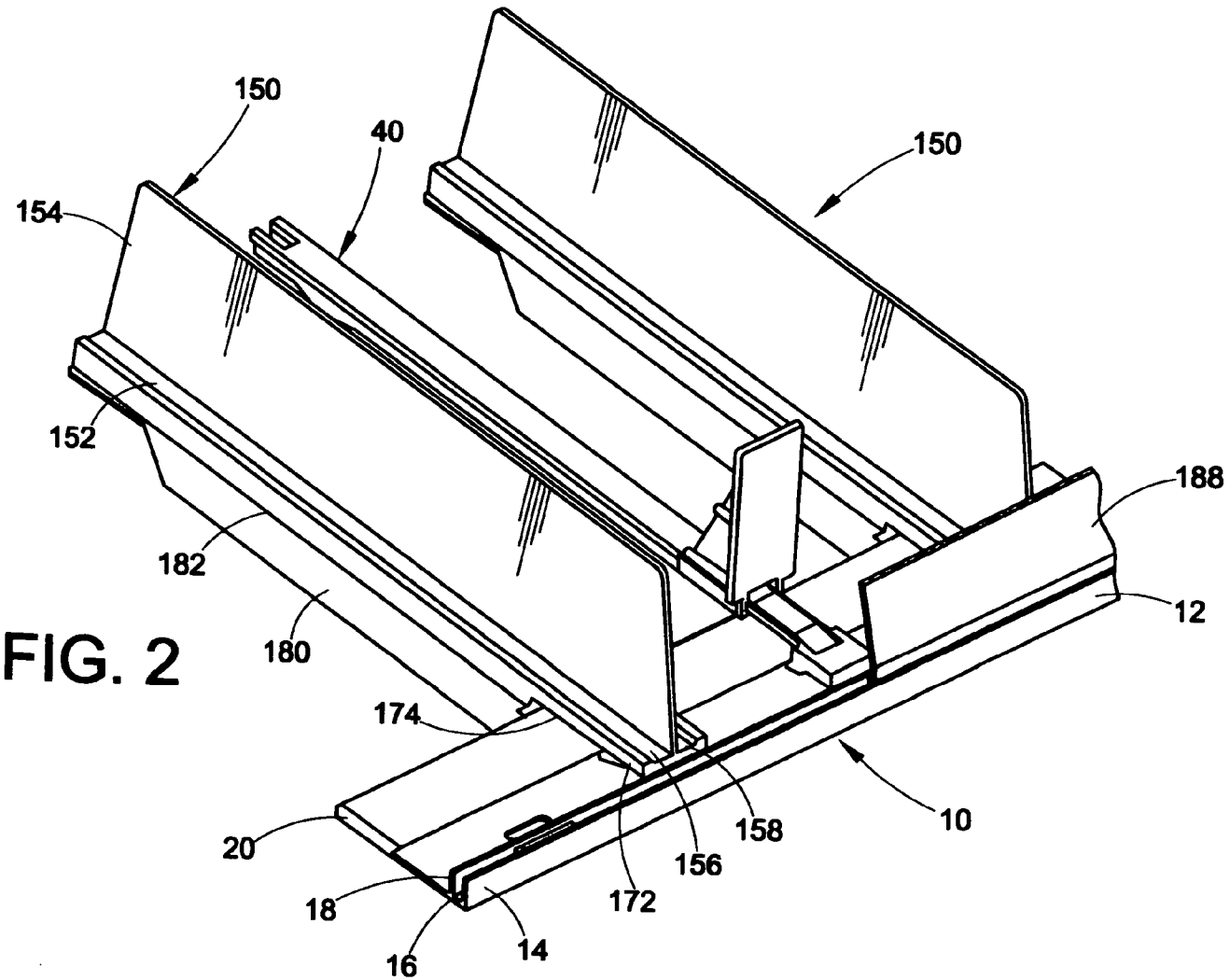
FIG. 2 is a reduced front perspective view of the merchandising system of FIG. 1, also including a pair of dividers and a front fence.
Figure 4:
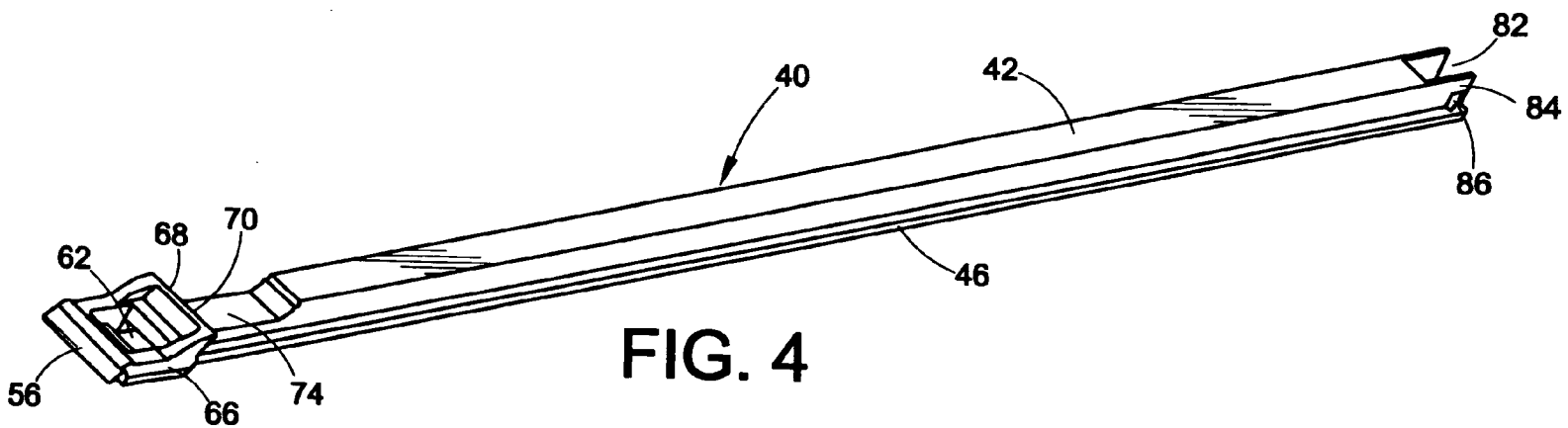
FIG. 4 is a bottom side perspective view of the track of FIG. 1.

The mounting head 52 also includes a top face 60. An aperture 62 extends through the top face, as is evident from a comparison of FIGS. 3 and 4. The mounting head also includes a first side wall 64, a second side wall 66 and a rear wall 68. Depending from the rear wall is a projection 70. Located in the pusher track 40 behind the mounting head 52 is a cross slot 74, as best seen in FIG. 4. The cross slot is meant to accommodate the plateau-like portion of the front rail, as is evident from FIGS. 1 and 2.

With reference again to FIG. 3, the pusher track includes a rear end 80. Extending through the rear end is a vertically oriented slot 82. The slot 82 thus divides the track rear end into two portions or defines extensions 83 and 84. Such extensions allow the track rear end to be flexible, in relation to the remainder of the track. Located on opposed side faces of the track body 42, adjacent the slot 82, are first and second teeth 85 and 86. The teeth can be located directly beneath the first and second rails 44 and 46.

Figure 6:
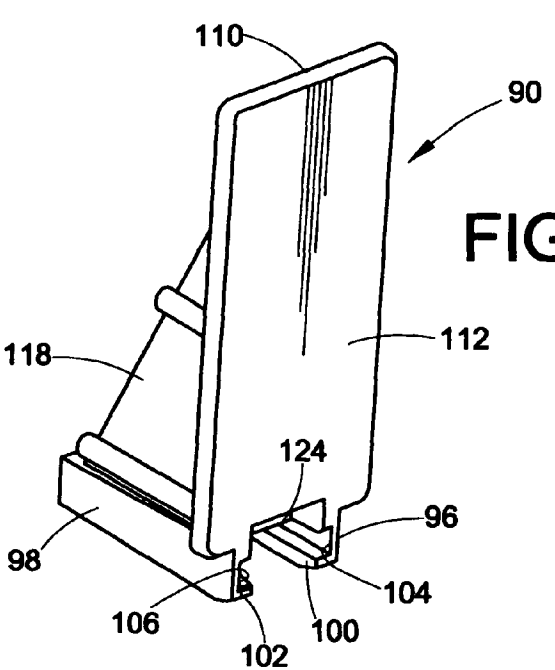
FIG. 6 is a front perspective view of the pusher of FIG. 5.
Figure 5:
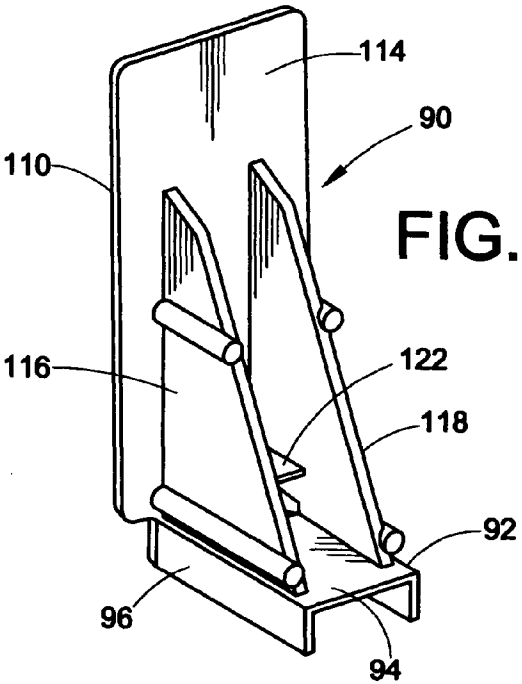
FIG. 5 is an enlarged rear perspective view of a pusher mounted on the track of FIG. 1.
Figure 7:
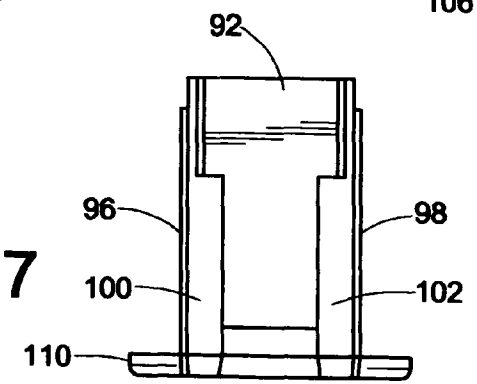
FIG. 7 is a reduced bottom plan view of the pusher of FIG. 5.

With reference now to FIG. 5, a pusher 90 is adapted to be mounted on the pusher track 40. The pusher 90 includes a base 92. The base comprises a top wall 94, a first side wall 96 and a second side wall 98 (FIG. 6). Thus, an inverted channel-like configuration is defined. With reference now also to FIG. 7, a first flange 100 extends from the first side wall 96 and a second flange 102 extends from the second side wall 98. With reference to FIG. 6, a first groove 104 is defined in the first side wall 96 and the second groove 106 is defined in the second side wall.

Figure 9:
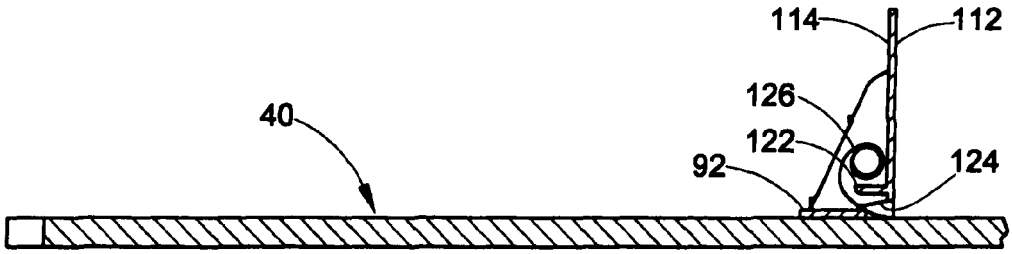
FIG. 9 is a reduced side elevational view, in cross section, of the merchandising system of FIG. 1.

A paddle 110 is mounted on the base 92. FIG. 6 shows that the paddle includes a front face 112. With reference again to FIG. 5, the paddle also includes a rear face 114. Supporting the rear face are first and second gussets 116 and 118, which extend from the paddle rear face to the base top wall 94. The gussets reinforce the pusher 90 and prevent the paddle 110 from buckling. A support wall 122 is disposed between the pair of gussets, in a manner spaced from the pusher base top wall 94. With reference now to FIG. 9, a suitable coil spring 126 is mounted on the support wall 122. As best shown in FIG. 1, the coil spring has a front portion 128 and a front end 130. The coil spring front end includes a bent portion (not visible) which extends into the aperture 62 in the pusher track and engages the track to retain the spring in place. This is conventional in the art.

When merchandise (not illustrated) is placed on the track 40 as in FIG. 1, the merchandise sits on the forward portion 128 of the coil spring. The spring, since it is made from a suitable conventional metal, is inherently somewhat more slippery than the material of the track. Since the coil spring sits directly on the track, the merchandise sits on the coil spring and, thus, can slide more easily than if it sat directly on the track. In another embodiment, ribs (not shown) could be provided laterally on both sides of the coil spring so as to further reduce frictional contact between the track and merchandise supported on the track.

In order to mount the pusher 90 on the pusher track 40, the two portions or extensions 83 and 84 of the track body rear end 80 are pushed towards each other. Due to the resilient and flexible nature of the thermoplastic material from which the track body is made, and due to the presence of the vertical slot 82, a width of the track rear end can be reduced so as to allow the pusher base to be mounted on the pusher track. Once the pusher is mounted, the rear end portions 83 and 84 return to their normal orientation because of the inherent resiliency of the material from which the track is made. When so mounted, the first and second rails 44 and 46 of the pusher track are accommodated in the first and second grooves 104 and 106 defined in the base 92 of the pusher 90. Therefore, the pusher 90 is allowed to reciprocate on the track 40. Also, the pusher is urged in a forward direction by the coil spring 126.

The teeth 85 and 86 at the rear end of the pusher track 40 prevent the pusher 90 from sliding off the track at the rear end thereof. More particularly, the side walls 96 and 98 of the pusher engage the teeth 85 and 86 to prevent the pusher from being slid off the track. However, in case the pusher needs to be removed, a merchant simply needs to press the two portions 83 and 84 of the track rear end towards each other so as to allow the pusher to clear the teeth. In order to prevent the pusher from sliding off the forward end of the track, it is apparent from, e.g., FIG. 1, that the pusher track mounting head 52 is larger in width than is the remainder of the pusher track. This serves several purposes.

First, it prevents the pusher from sliding off the track in a forward direction. Secondly, the wider mounting head 52 on the pusher track 40 prevents engagement between adjacent pushers mounted on adjacent tracks. Such engagement is disadvantageous as it would retard the ability of the pusher to slide forward and rearward on the track. Thus, the relative width of the mounting head 60 is such that it is at least as wide as a cross section taken through the pusher track and the pusher, at the location of the pusher 90. This cross sectional relationship prevents the pusher from getting hung up on an adjacent pusher track or being inadvertently moved, when it is located next to another pusher on an adjacent pusher track.

With reference again to FIG. 2, a divider 150 according to one embodiment of the present disclosure includes a base 152 and an upright wall 154 protruding from the base. The upright wall can separate the base into a first section 156 and a second section 158. Located adjacent a front end of the base is a projection 172. Located rearwardly of the projection is a cross slot 174. The cross slot is meant to accommodate the plateau-like raised section of the front rail horizontally oriented wall. In this embodiment, a side wing 180 is located on one side of the base 152. For narrow products, such as, e.g., a row of tooth brushes, the wing 180 can be broken off from the divider base along a break line or weakened line 182. In this way, the divider can be made narrower when that is necessary. It should be apparent that the break line 182 can extend parallel to a longitudinal axis of the divider 150. A front fence 188 can be inserted in the slot 16 located between the first and second sections 14 and 18 of the front rail vertical wall 12. The front fence can be made from a transparent material, so that the merchandise being displayed on the shelf (not illustrated) is visible to the customer.

Figure 10:
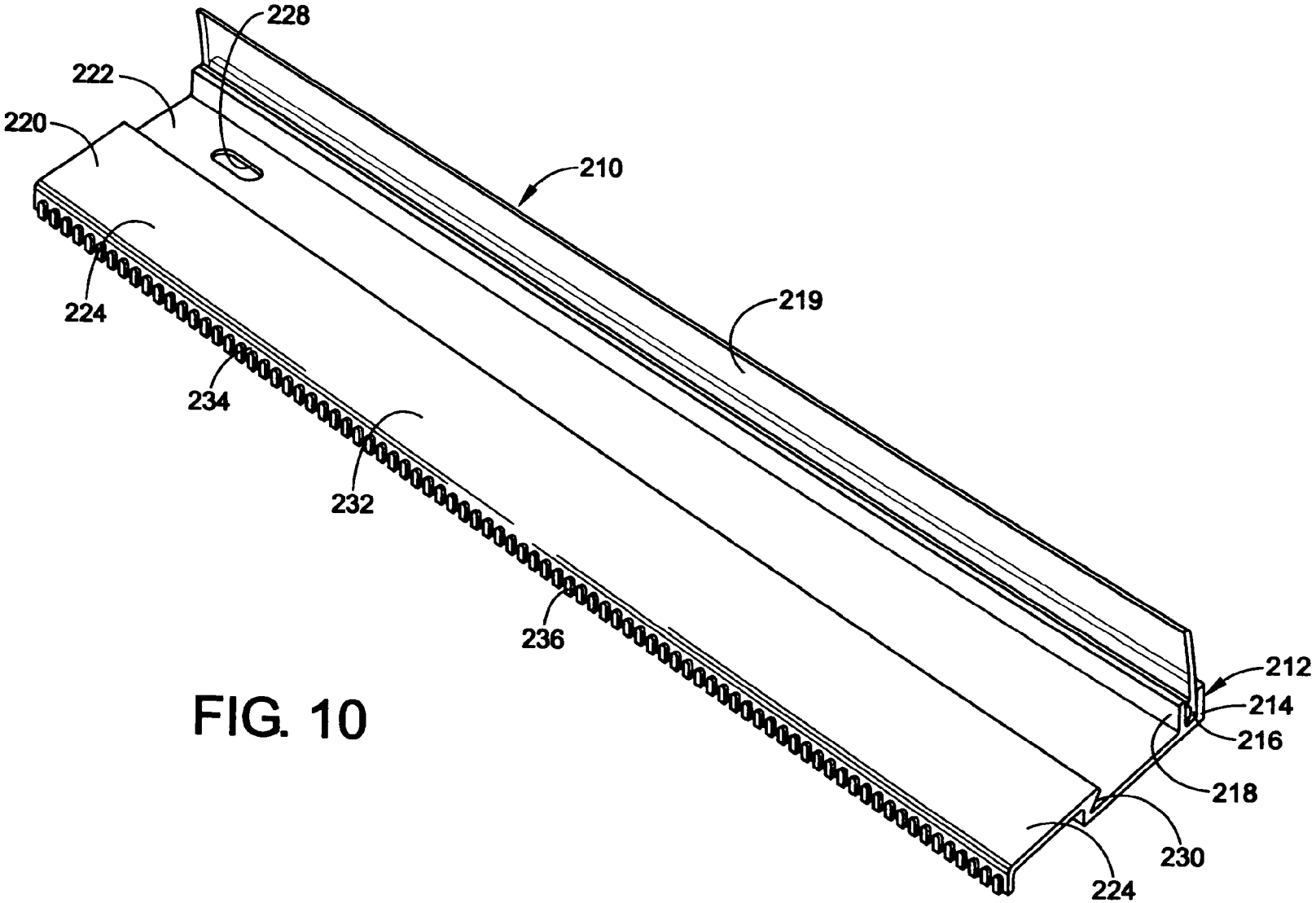
FIG. 10 is a rear perspective view of a front rail according to a second embodiment of the present invention.

With reference now to FIG. 10, a second embodiment of the merchandising system according to the instant disclosure includes an elongated mounting member, such as a front rail 210, which includes a vertically oriented wall 212, which, in turn, comprises a first section 214, a groove 216 and a second section 218. A front fence 219 can be mounted in the groove 216. Also provided on the front rail or mounting member 210 is a horizontally oriented wall 220. Disposed in the horizontally oriented wall is a second groove 222. An aperture 228 is positioned in the second groove 222, and extends through the horizontally oriented wall 220. A suitable conventional fastener (not illustrated) can extend through the opening 228 so as to secure the front rail in place on a shelf. The horizontally oriented wall 220 also comprises a plateau-like section 224 which includes a front face 230, a top face 232 and a back face 234. Located on the back face are a plurality of spaced protrusions, which can be teeth 236.

Figure 11:
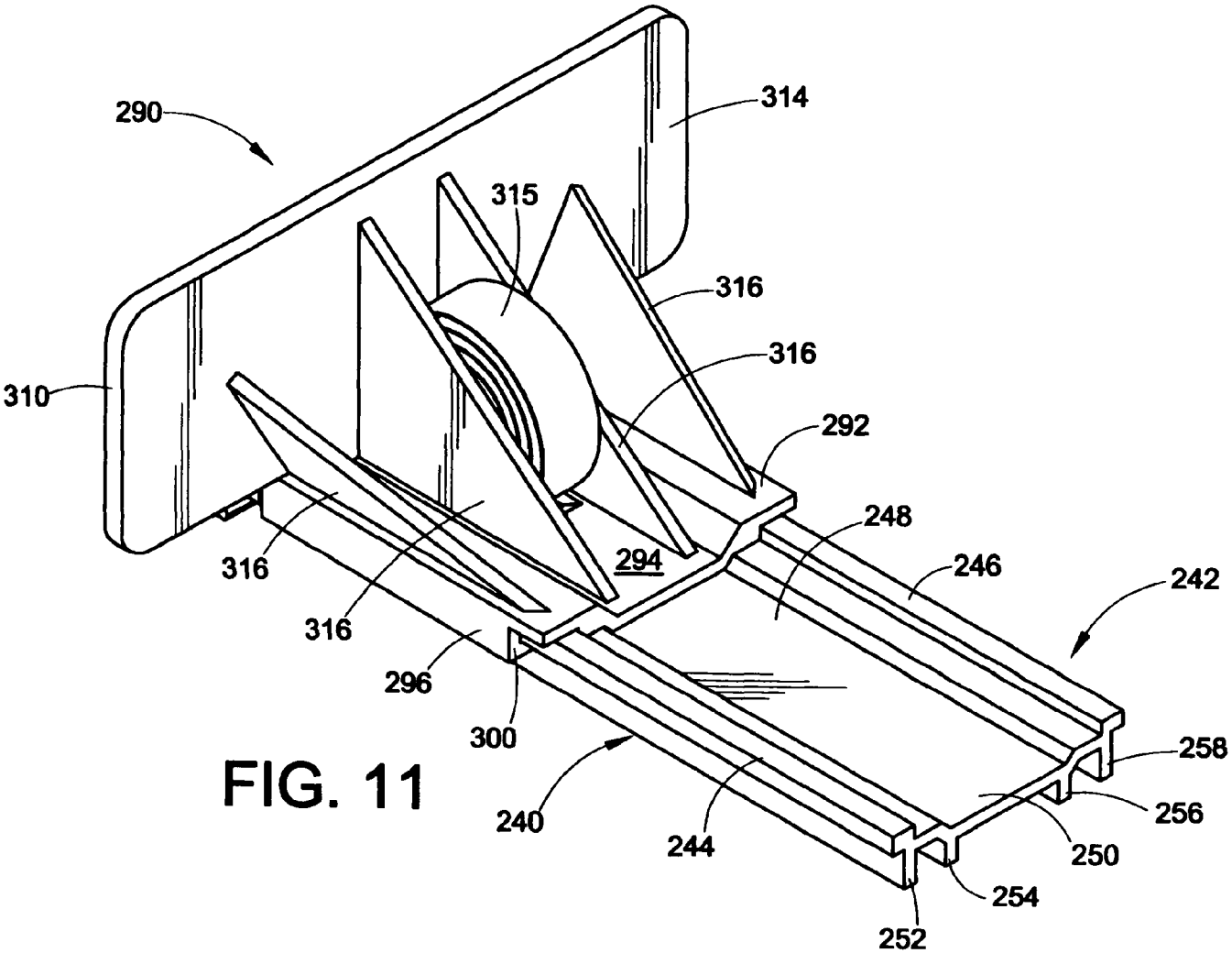
FIG. 11 is a rear perspective view of a short track which can be accommodated on the front rail of FIG. 10.
Figure 12:
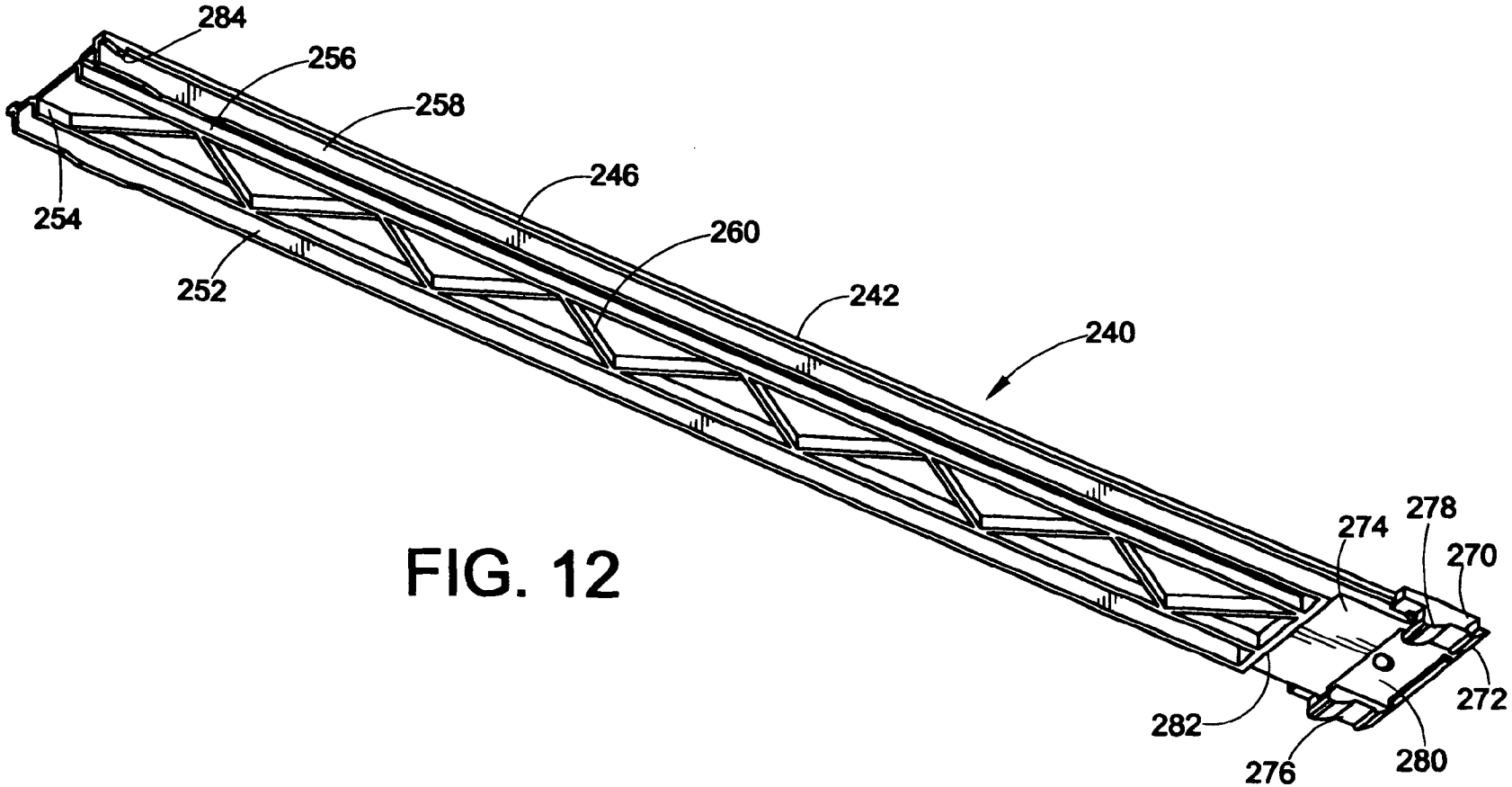
FIG. 12 is a bottom perspective view of an elongated track which can be accommodated on the front rail of FIG. 10.

With reference now also to FIG. 11, a cooperating member, such as a pusher track 240 is selectively mounted on or to the front rail 210. As best shown in FIG. 12, the track 240 can include an elongated track body 242, of any desired length. Defined thereon are a pair of oppositely extending rails 244 and 246. The track also includes a recessed central section 248, as can best be seen in FIG. 11. Such recessed area 248 is defined in a horizontal wall 250 of the track 240.

With reference now to FIG. 12, depending from the horizontal wall 250 are first, second, third and fourth reinforcing ribs 252-258. As is evident, the four reinforcing ribs are spaced from each other. Extending between the two inner reinforcing ribs 254 and 256 are a series of stiffening elements 260. These can be arranged in zigzag fashion, in order to provide additional strength or stiffness to the track 240. However, grooves (unnumbered) are defined between the first and second stiffening ribs 252 and 254, as well as between the third and fourth stiffening ribs 256 and 258. In other words, no stiffening elements are located in these grooves. In this embodiment, the track 240 can be injection molded from a suitable known material, such as a thermoplastic material.

The track also includes a front end 270 which extends forward of the reinforcing ribs 252-258, as well as the stiffening elements 260. Protruding from the front end 270 is a tongue 272. As in the embodiment illustrated in FIGS. 1-9, the tongue 272 contacts the rail vertically oriented wall second section 218 in order to correctly align the track with the rail and in order to prevent any looseness or wobbling of the track in relation to the rail. Defined on a bottom side of the track is a traverse slot 274. The slot is defined on a front side by a pair of depending flanges 276 and 278, separated by a gap 280. It is defined on a rear side by a wall 282 which serves as the forward terminus of the four stiffening ribs 254-258.

A respective tooth 284 can be located at a rear end of each of the rails 244 and 246. Only one of the teeth is visible in FIG. 12. The purpose for the teeth is to prevent a pusher 290 from being retracted so far that it falls off the track. To this end, the pusher 290 includes a base 292 which will contact the teeth 284. With reference again to FIG. 11, the base 292 includes a top wall 294 which can be recessed so as to be correctly accommodated on the track 240. The base also includes first and second sidewalls 296 and 298, as well as respective flanges extending inwardly therefrom. Only one such flange 300 is visible in FIG. 11. In other words, the base 292 wraps around the rails 244 and 246 located on the track 240.

Figure 13:
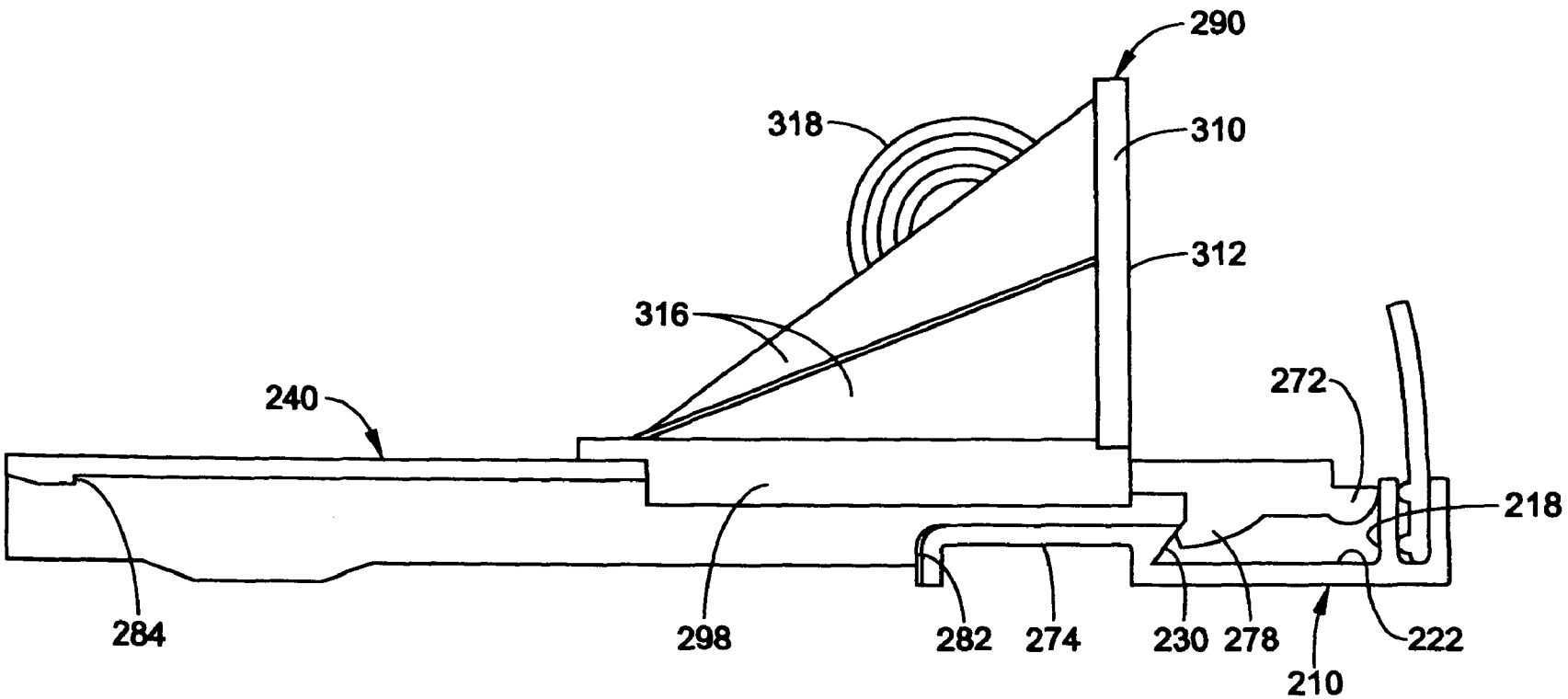
FIG. 13 is a side elevational view of the track of FIG. 11 assembled on the front rail of FIG. 10.

Supported on the base is a paddle 310. Included on the paddle is a front face 312 (FIG. 13) and a rear face 314 (FIG. 11). Unlike the paddle embodiment illustrated in FIG. 8, the paddle 310 shown in FIG. 11 is considerably wider than is the width of its track 240. For example, the paddle can be approximately twice as wide as the track. In this way, the paddle can accommodate wide merchandise, such as, for example, frozen TV dinners or the like. Of course, it should be appreciated that the paddle can have any desired shape and width depending upon the merchandise which is meant to be urged forwardly on the track. Supporting the rear face are a plurality of gussets 316. Since a wide paddle 310 is illustrated in this embodiment, the plurality of gussets are so arranged that the two outermost gussets are angled outwardly in order to better support the paddle 310 on the base 292. Disposed between the inner two gussets is a coil spring 318. As is well known in the art, the coil spring will bias the pusher 290 forwardly on the track 240.

With reference now again to FIG. 13, when the track 240 is assembled on the front rail 210, the pair of spaced flanges 276 and 278 will contact the front face 230 of the plateau-like section 224 and the slot 274 on the track 240 accommodates the plateau-like section. However, the forward wall 282 of the track is spaced from the teeth 236 defined on the back face 234 of the plateau-like section 224 so as to not interfere therewith. In addition, the forwardly extending lip 272 defined on the front end 270 of the track 240 will contact the second section 218 of the vertically oriented wall 212 of the front rail 210. However, this contact will be above the second groove 222 which is defined in the front rail 210.

With this arrangement, the track 240 is slidable laterally or sideways in relation to the track 210. However, disengagement of the track from the front rail can be achieved without having to slide the track sideways until it is detached from the front rail. Instead, one can twist the track about its longitudinal axis in a first direction such that a first one of the flanges 276 and 278 is disengaged from its contact with the plateau-like section 224 and then twist it in an opposite, second direction until the other flange is disengaged. This can be accomplished due to the inherent resiliency of the thermoplastic material from which the track 240 is made. Also, the front rail 210 can be made from a similar thermoplastic material, so that both the front rail and the track can have some "give".

Figure 14:
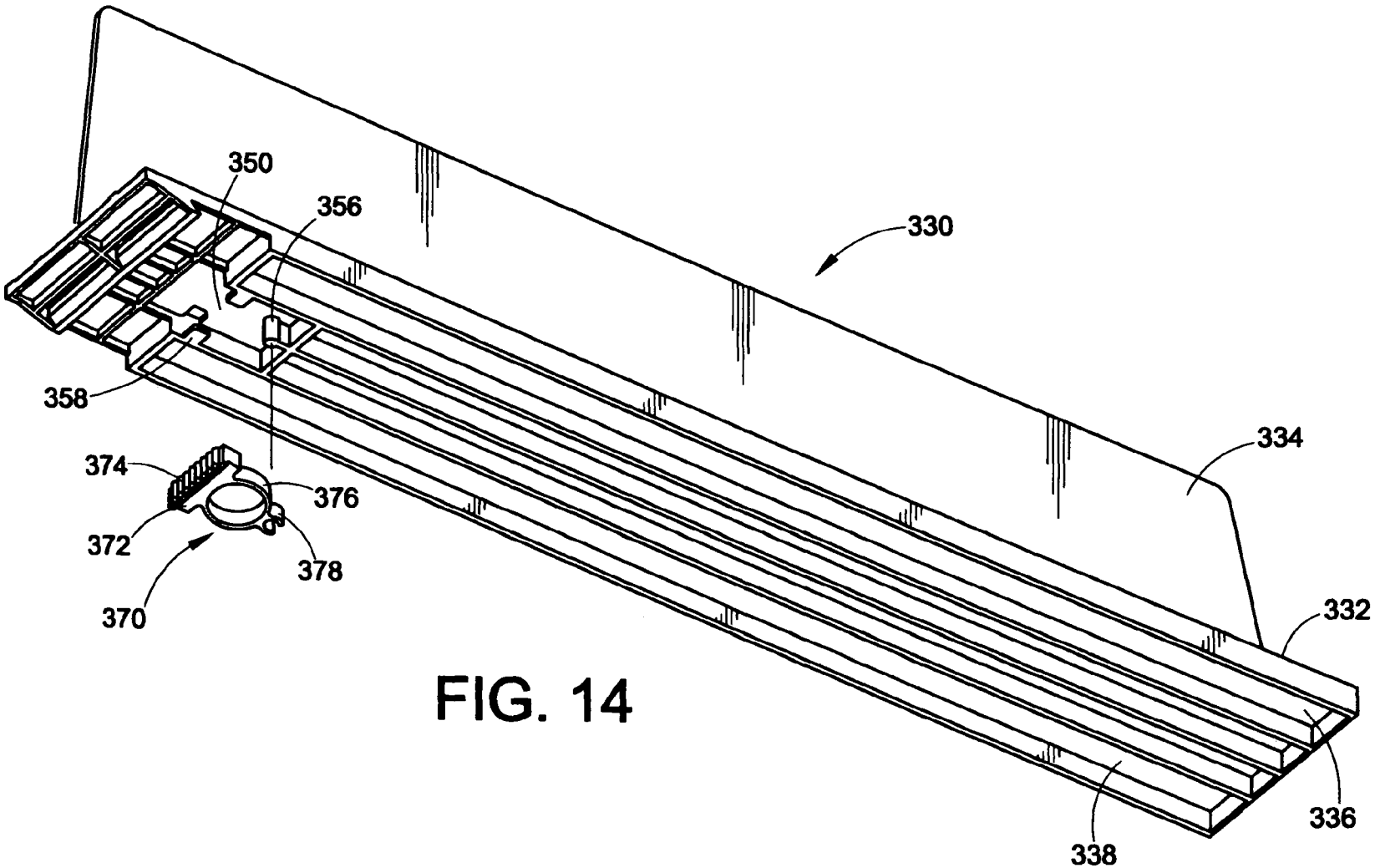
FIG. 14 is a bottom perspective view of a divider which cooperates with the front rail of FIG. 10.
Figure 15:
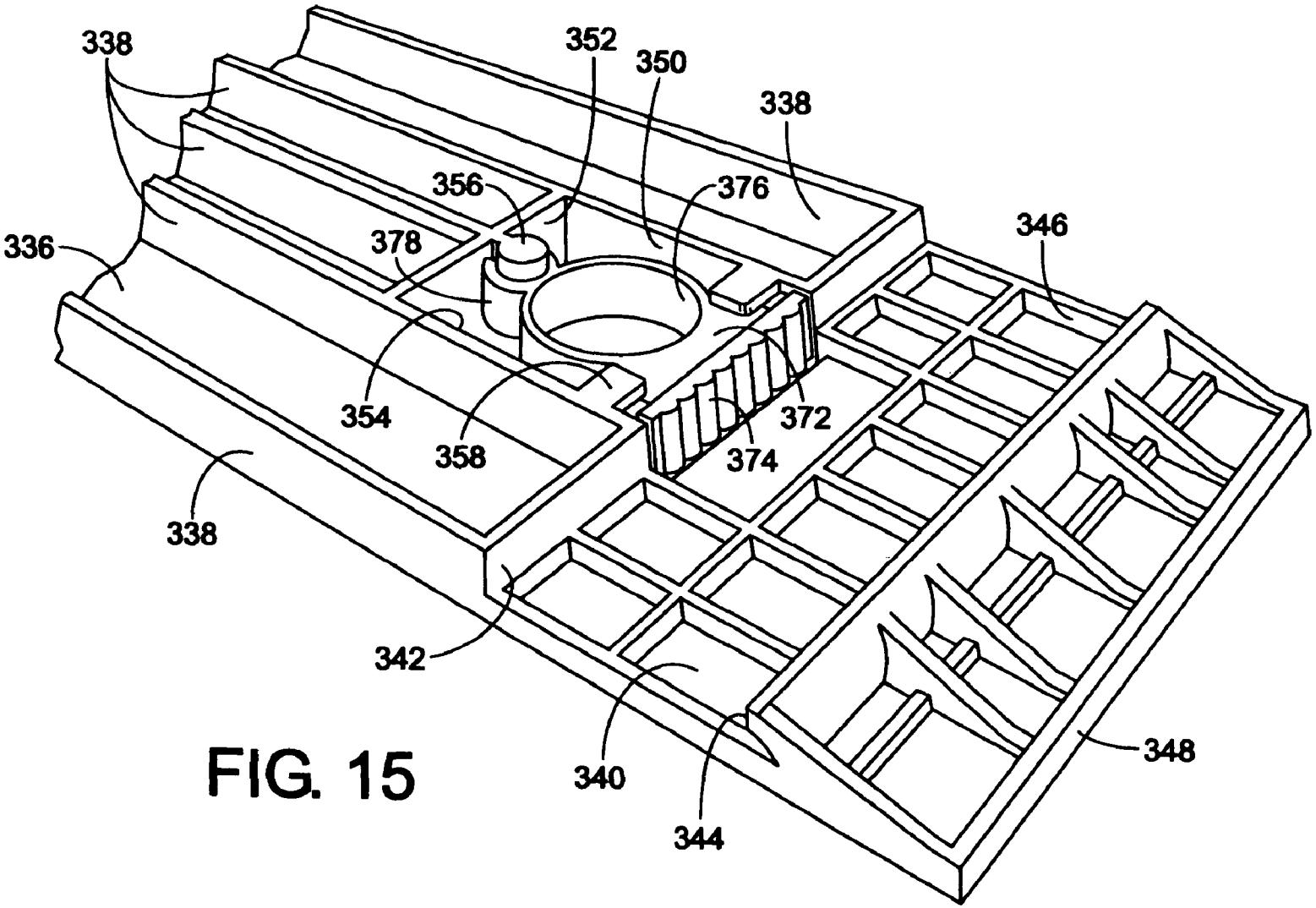
FIG. 15 is an enlarged bottom perspective view of a front portion of the divider of FIG. 14 with the remainder thereof broken away.

With reference now to FIG. 14, a cooperating member, such as a divider 330 can also be employed with the front rail 210, as is there illustrated. The divider includes a base 332 and, extending upwardly therefrom, a vertical wall 334. The vertical wall can divide the base into opposed sections. The base itself is defined by a horizontal wall 336 and, depending therefrom, a plurality of reinforcing ribs 338. These can best be seen in FIG. 15. Five such reinforcing ribs are illustrated in the embodiment of FIGS. 14 and 15. Of course, any suitable number can be employed. Alternatively, a solid base can be employed, as shown for the track in FIGS. 8 and 9. The reinforcing ribs terminate at a transverse slot 340 defined in a bottom face of the divider 330. In the embodiment shown, the transverse slot comprises a rear wall 342 at which all of the reinforcing ribs 338 terminate, as well as a front wall 334. It should be apparent from FIG. 15 that suitable reinforcing walls 346 can be provided in the slot so as to stiffen the divider 330 in that area. Also provided on the divider is a front face 348.

Defined in the base is a chamber 350. In the embodiment shown, the three central walls 338 define the chamber 350. More particularly, the chamber comprises a rear wall 352 and a pair of side walls 354. A protrusion 356 extends into the chamber from the rear wall. Also extending above the chamber from the side walls 354 are a pair of flanges 358. Selectively mounted in the chamber 350 is an engaging element 370. In the embodiment illustrated, the engaging element comprises a face 372 on which are defined a plurality of spaced protrusions 374. The engaging element also comprises a biasing member 376. A clip 378, located on the biasing member, enables the engaging element to be selectively mounted on the protrusion 356 extending into the chamber 350, as is evident from FIG. 15. In other words, the engaging element 370 can be detached from the divider 330 when so desired.

Figure 16:
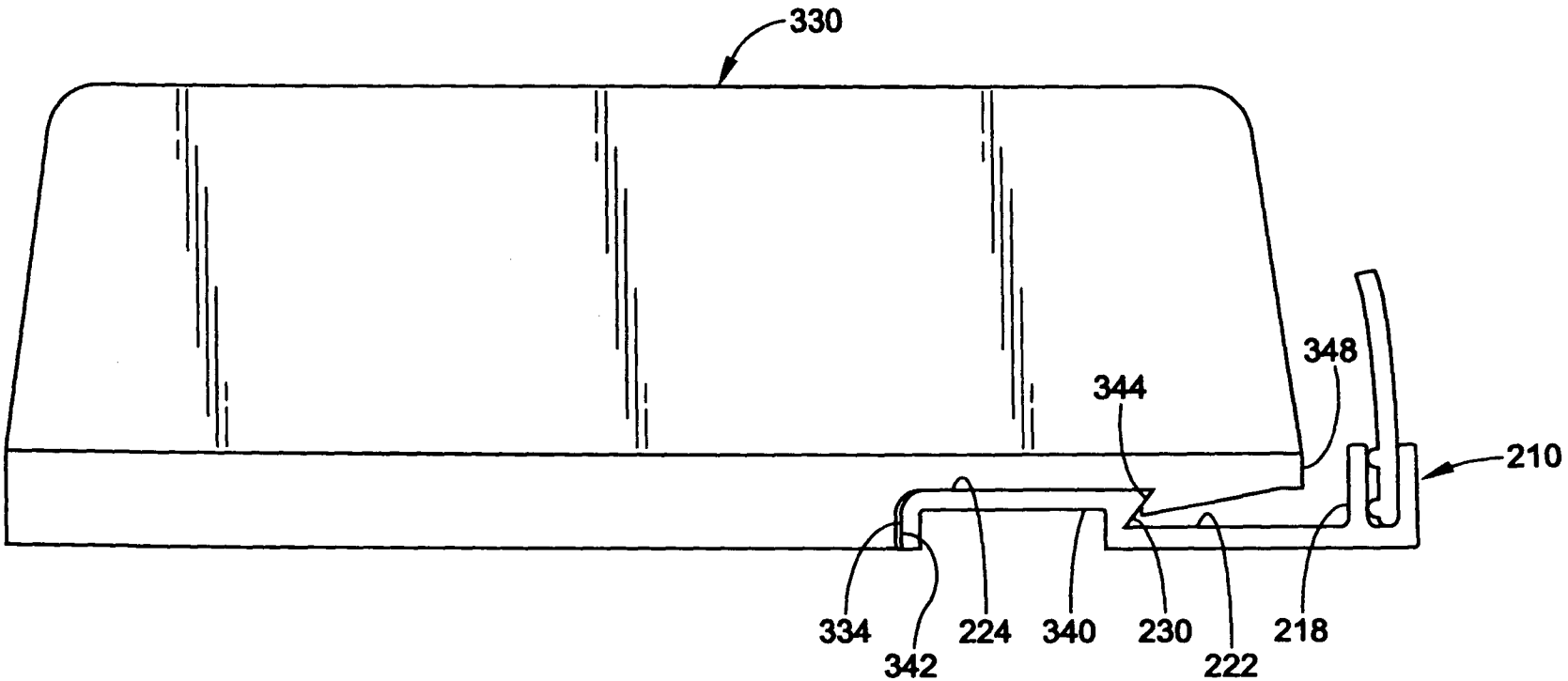
FIG. 16 is a side elevational view of the divider of FIG. 14 assembled on the front rail of FIG. 10.
Figure 17:
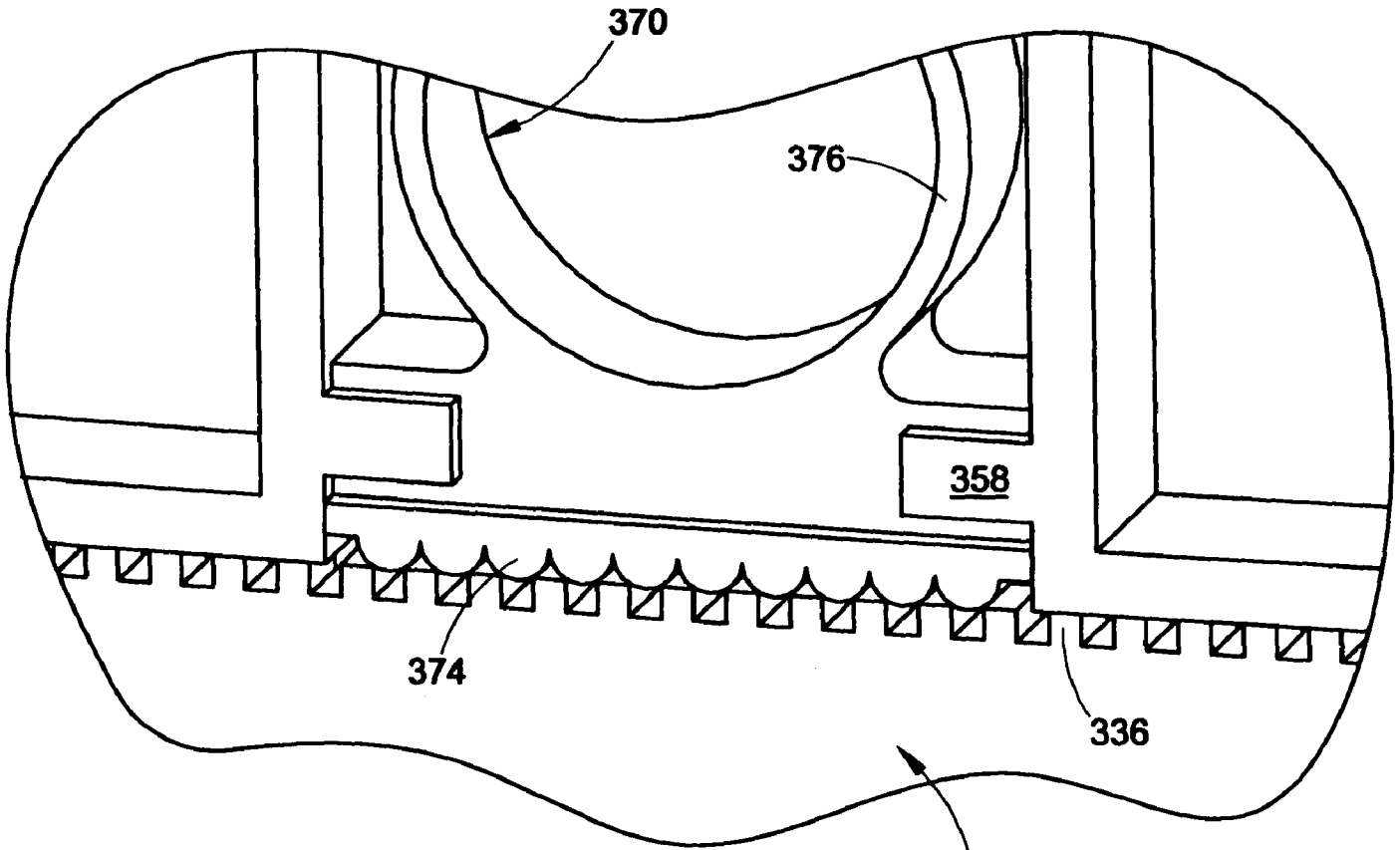
FIG. 17 is a greatly enlarged bottom perspective view of a portion of the front rail and divider of FIG. 16.

With reference now to FIG. 16, in use, the divider 330 is mounted on the front rail 210. When so mounted, the transverse slot 340 accommodates the plateau-like section 224 of the front rail. Also, the front wall 334 of the transverse slot 340 contacts the front face 230 of the plateau-like section 224. At the same time, the rear wall 342 contacts the back face 334 of the plateau-like section 224. However, the front face 348 of the divider is spaced from the second section 218 of the front rail vertically oriented wall 212. With reference now to FIG. 17, it can be seen that the engaging element 370 contacts the plateau-like section 224 of the front rail. More particularly, the protrusions 374 of the engaging element 370 engage the teeth 236 defined on the back face 234 of the front rail plateau-like section 224. Thus, the rail 210 and divider 33 are selectively attached, fixed, connected, joined or secured to each other, in a way to retard relative movement between them.

It should be appreciated that while particular designs of protrusions 374 and teeth 236 are illustrated, any suitable types of engaging elements can be employed for this purpose. In other words, while differently shaped protrusions and teeth are shown, these two elements can have the same shape, if so desired. In the embodiment illustrated, the rounded shapes of the protrusions 374 allow the divider 330 to ratchet in relation to the front rail 220 when the rear end of the divider is lifted, even a slight amount. Thus, in this embodiment, the divider can be moved without completely retracting the engaging element from contact with the teeth 236.

It should be appreciated that the biasing member 376 allows the engaging element 370 to be resiliently biased into contact with the front rail teeth 236, due to the inherent resilient nature of the thermoplastic material from which the engaging element can be made. However, it should be appreciated that the engaging element could also be made from other suitable materials, such as various metals or the like. It should thus be appreciated that the engaging element could be made from a different material than the cooperating member or the mounting member. In addition, various sections of the engaging element could be made from different materials, if so desired. For example, the biasing member 376 could be made from a more resilient material than the face 372.

The purpose for the flanges 358 is to prevent the engaging element 370 from falling out of the chamber 350. They also provide guidance for the movement of the engaging element 370 as it reciprocates due to the inherent resiliency of the biasing member 376. Such reciprocation occurs when the divider 330 is detached from and attached to the front rail 210. As noted, this can be accomplished by simply pivoting the rear end of the divider in an upward direction. Depending on the degree of pivoting, such action can disengage the protrusions 374 and the teeth 236. Alternatively, depending on the shapes of the protrusions and teeth, it can allow a relative movement between them, even when they are contacting each other.

Figure 18:
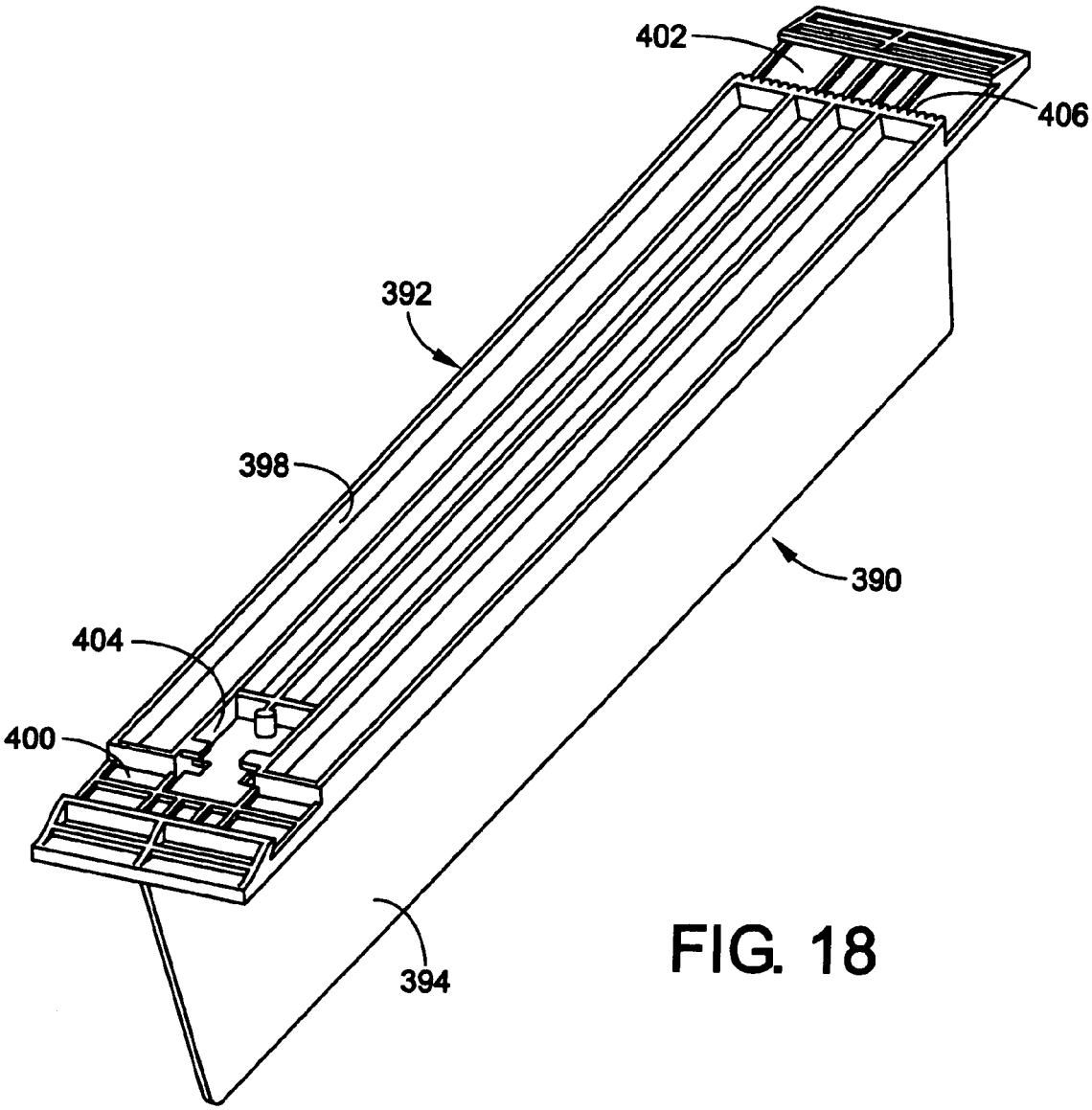
FIG. 18 is a bottom perspective view of a divider according to a third embodiment of the present invention.

With reference now to FIG. 18, another embodiment of a divider 390 is there illustrated. In this embodiment, the divider is provided with a base 392 and a vertical wall 394 extending upwardly from the base. A plurality of reinforcing ribs can depend from the base. In this embodiment, a first transverse slot 400 and a second transverse slot 402 are located on opposed ends of the base. The first transverse slot includes a chamber 404 for selectively accommodating an engaging element, such as the engaging element 370 illustrated in FIG. 14. The second transverse slot includes a plurality of protrusions 406. Depending on the orientation of the divider 390 on the front rail, and assuming that an engaging element is not placed in the chamber 404, the divider can either lock against the front rail or be continuously slidable in relation to the front rail.

Figure 19:
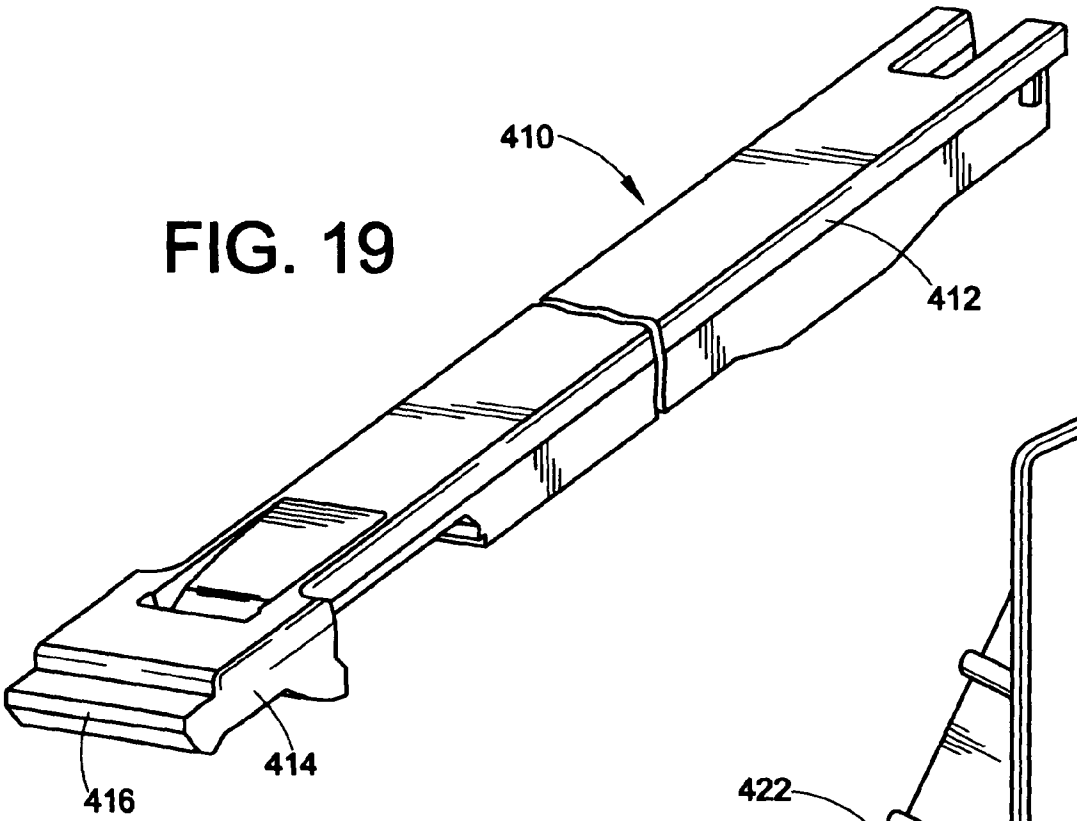
FIG. 19 is a top perspective view of a track according to a third embodiment of the present invention.
Figure 20:
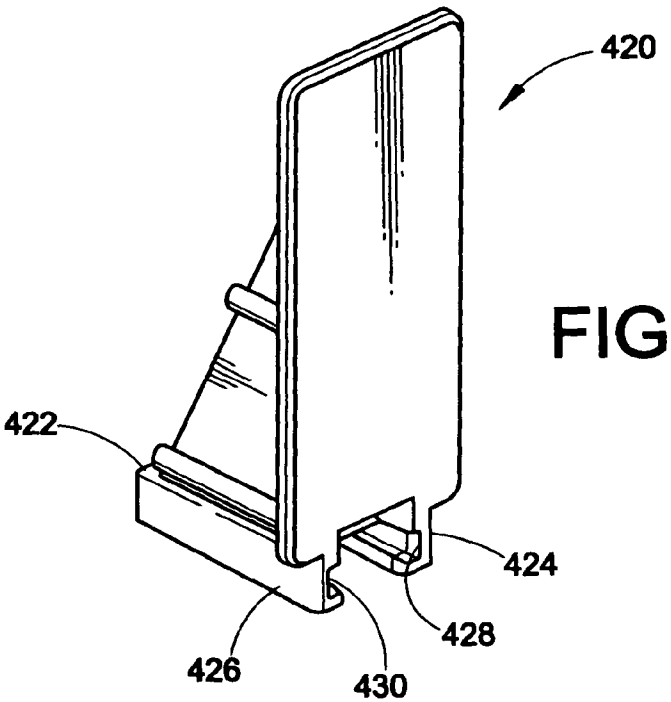
FIG. 20 is a perspective view of a pusher meant to be accommodated on the track of FIG. 19.
Figure 21:
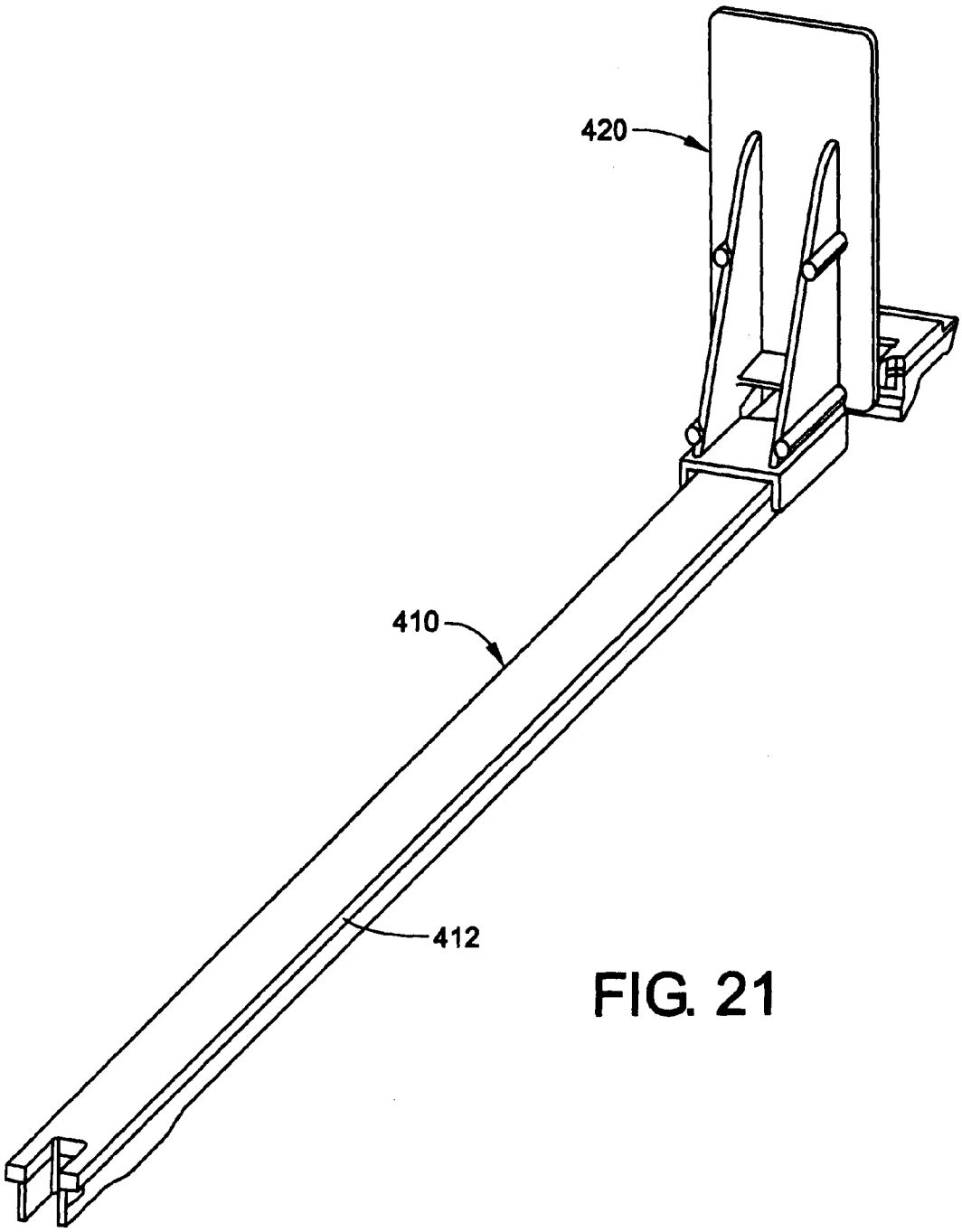
FIG. 21 is a rear perspective view of the track of FIG. 19 with the pusher of FIG. 20 mounted on the track.

With reference now to FIG. 19, another type of track 410 is there illustrated. This track is similar to track 40 illustrated in FIG. 3. It includes a pair of rails 412 (see also FIG. 21) and a front end 414 which is provided with a tongue or protrusion 416. In contrast to the design shown in FIG. 3, the tongue 416 is not movable in relation to the front end, unlike the tongue 56 illustrated in FIG. 3. Slidably mounted on the track 410 is a pusher 420. As shown in FIG. 21, the pusher 420 can reciprocate on the track 410. The pusher includes a base 422 which is provided with a first side wall 424 and a second side wall 426. Each of these has a respective groove 428 and 430 therein for accommodating the rails 412 of the track 410.

Figure 22:
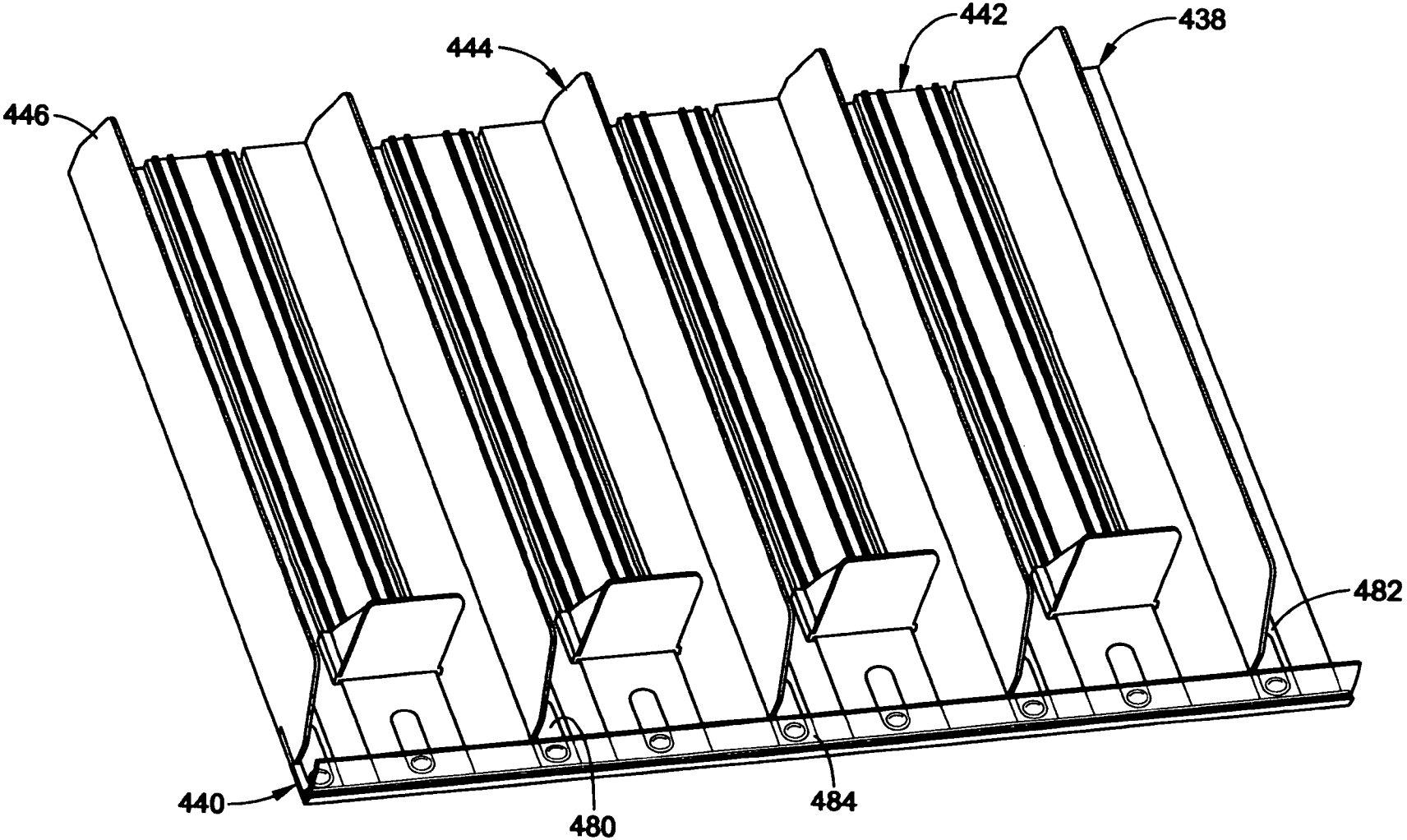
FIG. 22 is a top perspective view of a shelf management system according to a fourth embodiment of the present invention, including a front rail, several tracks and several dividers.
Figure 23A:
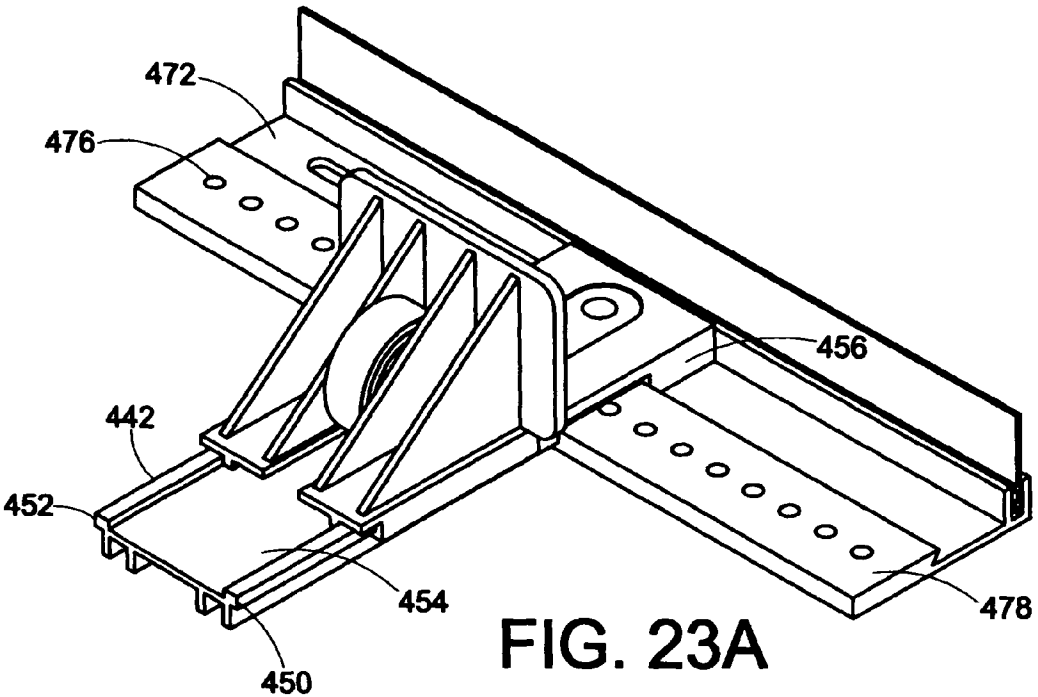
FIG. 23A is a rear perspective view of a front portion of the shelf management system of FIG. 22 illustrating only the front rail and a section of a track.
Figure 23B:
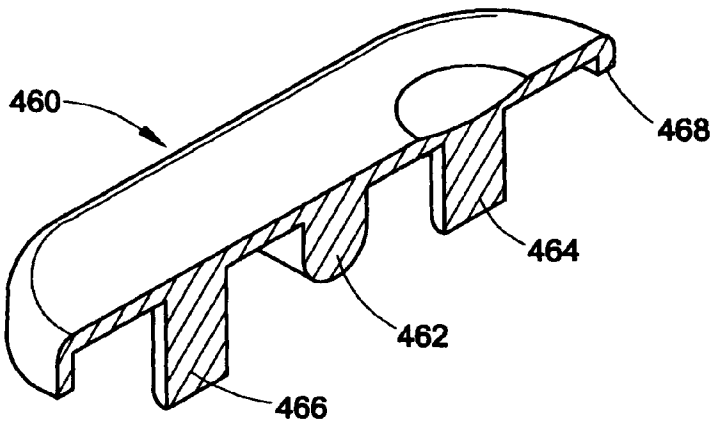
FIG. 23B is a greatly enlarged cross-sectional view of a locking element employed with the track of FIG. 23*a;*

With reference now to FIG. 22, another embodiment of a merchandising system 438 is there illustrated. This embodiment includes a mounting member in the form of a front rail 440, one or more tracks 442 and one or more dividers 444. An end wall 446 can also be provided. With reference now to FIG. 23A, the track 442 includes a pair of rails 450 and 452. The rails extend from a base 454 of the track. The track base includes a front portion 456. Pivotally mounted in a slot 458 defined in the front portion 456 is a locking element 460. As best illustrated in FIG. 23B, the locking element 460 includes a pivot section 462, as well as first and second stems 464 and 466.

Figure 24A:
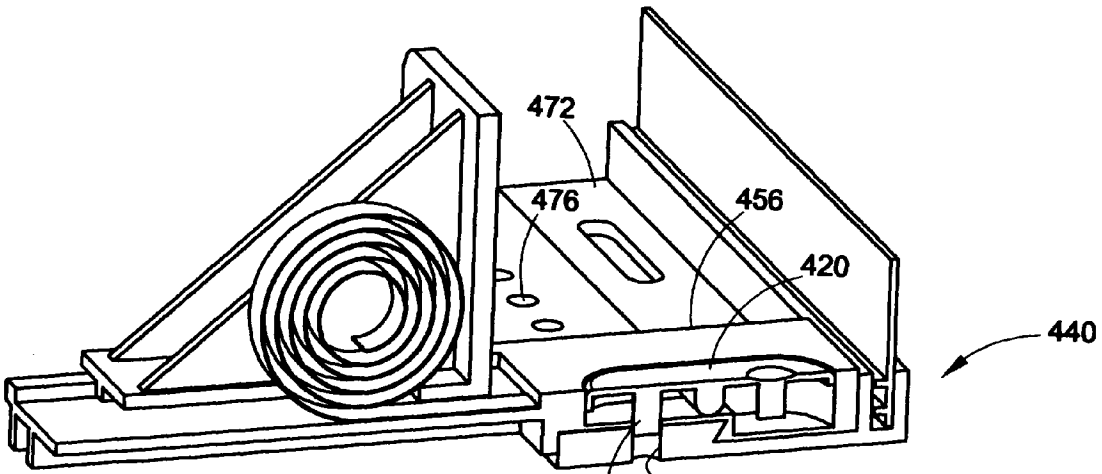
FIG. 24A is a perspective view of the front rail and track of FIG. 23A, enlarged and partially broken away, with the locking element in a first position, locking the track to the front rail.
Figure 24B:
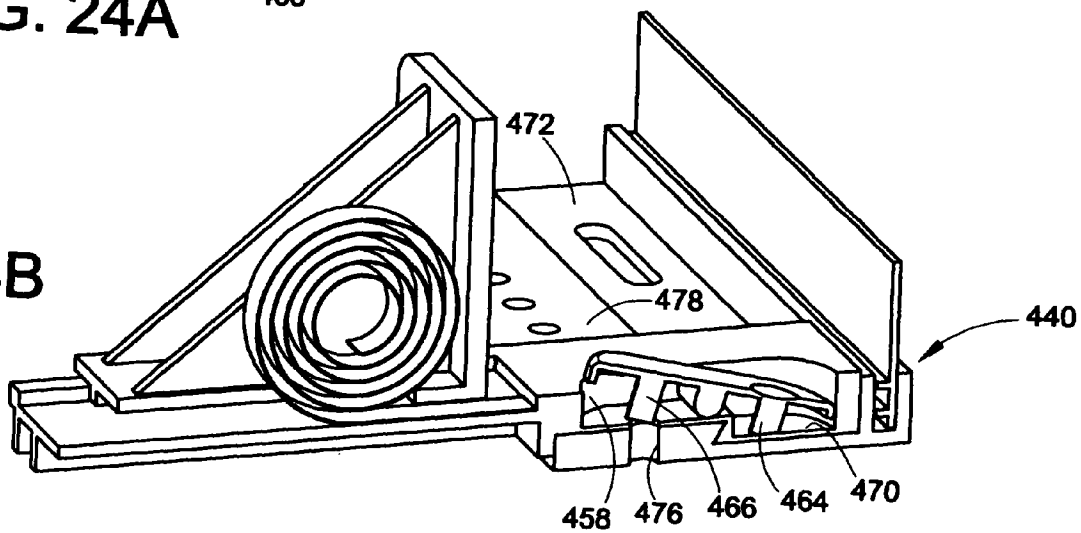
FIG. 24B illustrates the locking element of FIG. 24A in a second position, allowing the track to move in relation to the front rail.

As best illustrated by a comparison of FIGS. 24A and 24B, the locking element 460 can be pivoted around the pivot section 462 so as to assume either the locked position, illustrated in FIG. 24A, or the unlocked position, illustrated in FIG. 24B. In the unlocked position, the locking element 460 is pivoted so that the first stem 464 is pushed down at contact surface 468 and approaches a base wall 470 defined in a groove 472 in the front rail 440. In one embodiment, the first stem 464 contacts the groove 472 (see FIG. 24B) in order to limit the rotation of the locking element 460. As a result, the second stem 466, which can also be termed a locking stem, is withdrawn from its locked position in an aperture 476 in a plateau section 478 of the front rail 440. When thus unlocked, the track can be slid laterally on the front rail 440. When the track is placed in the desired location, the locking element 460 can be released. This allows the locking stem 466 to enter the subjacent aperture 476 thereby locking the track at the desired location along the length of the front rail 440.

Since a plurality of spaced apertures are located on the plateau section, the track can be locked to the rail at a number of discrete positions. It should be appreciated that the locking element is biased into the locked position around the pivot 462. This can be accomplished by the inherent resiliency of the thermoplastic material from which the locking element 460 can be made. In other words, the locking element can be rotated around the pivot section 462, but when finger pressure is released from the locking element, i.e., the person's digit is withdrawn from the contact surface 468, the locking element will return to its unbiased condition illustrated in FIG. 24A.

With reference again to FIG. 22, it should be appreciated that the dividers 446 can be provided with a similar locking arrangement, including locking elements 480 mounted in a front section 482 of a base portion 484 of the divider 444. The locking elements 480 can function in the same manner as outlined above for the locking element 460 mounted on the track 442. The end wall 446 can be provided with a similar locking element.

Figure 25:
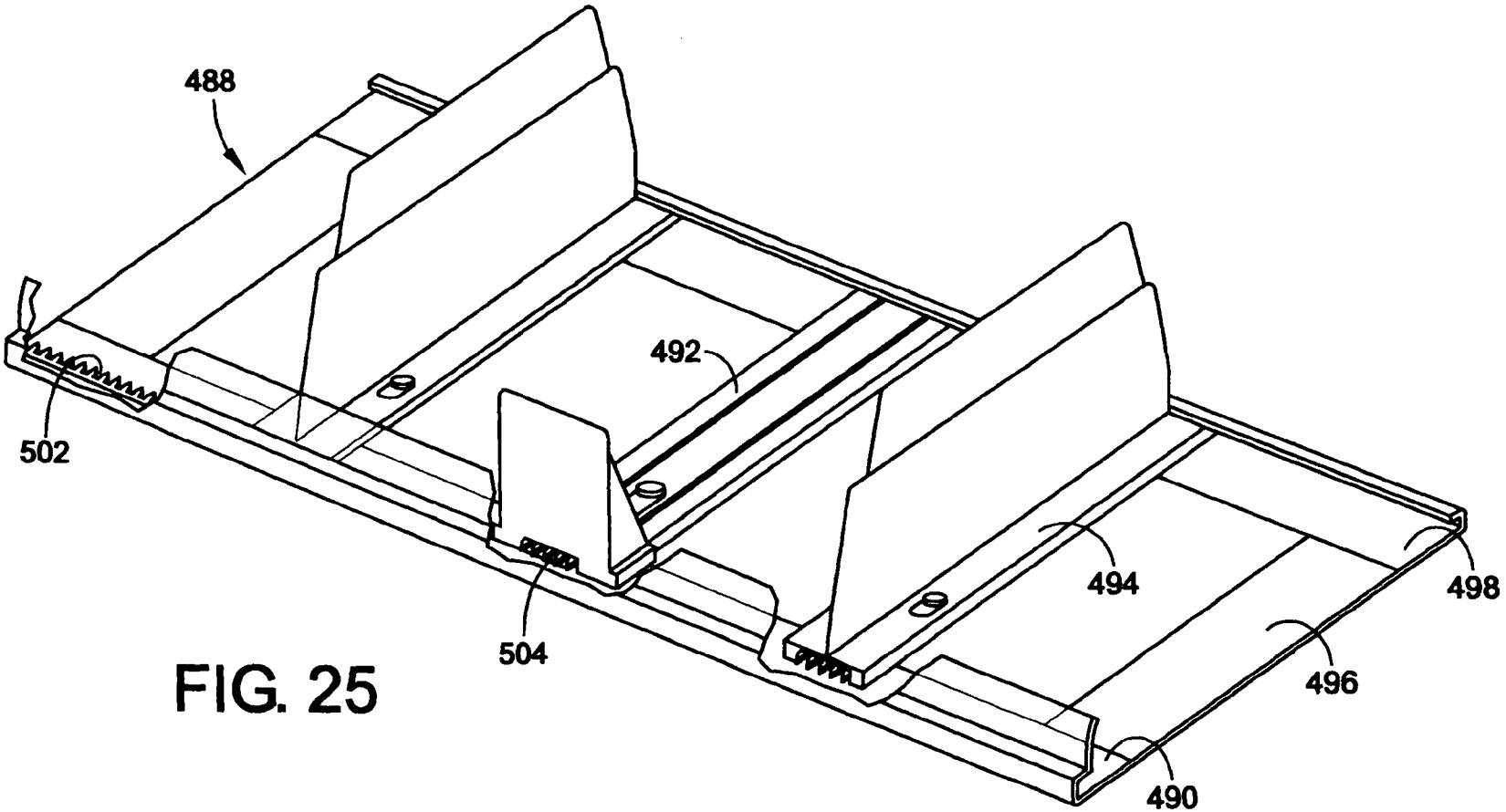
FIG. 25 is a front perspective view of a merchandising system according to a fifth embodiment of the present invention, including a front rail, a track and a pair of dividers.
Figure 27:
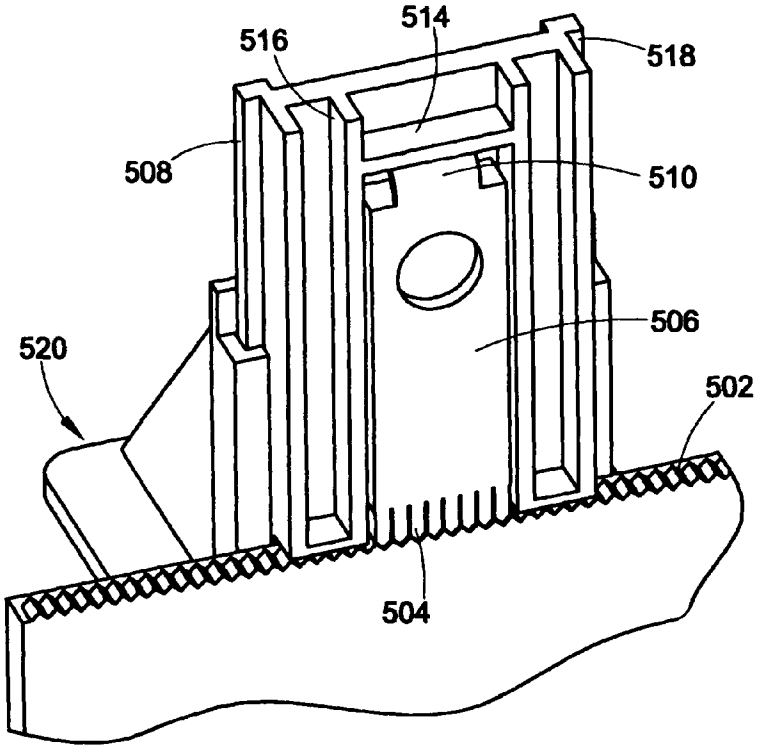
FIG. 27 is an enlarged partially broken away bottom perspective view of the track and the front rail of FIG. 26, showing a locking engagement to prevent movement of the track in relation to the front rail.

With reference now to FIG. 25, a still further design of a merchandising system 488 is there illustrated. In this design, a front rail 490 accommodates one or more tracks 492 and one or more dividers 494. If desired, the front rail can be mounted to a base section 496 which, in turn, is connected to a rear rail 498. In this embodiment, both the divider and the track include engaging elements which selectively contact a suitably shaped engagement surface on the front rail. More particularly, teeth 502 are provided on the front rail. With reference now to FIG. 27, the teeth 502 selectively engage mating engagement elements, such as teeth 504 provided on a moveable engaging member 506 which can be mounted for a reciprocation on a base 508 of the track 492.

In one embodiment, a biasing member 510 extends from a rear surface of the engaging member 506. The biasing member pushes against a cross bar 514 provided on a bottom surface of the base 508 in order to push the engaging member teeth 504 into mating engagement with the mounting member teeth 502. The engaging member 506 is held between a pair of longitudinally extending reinforcing ribs mounted on the base 508.

Figure 26:
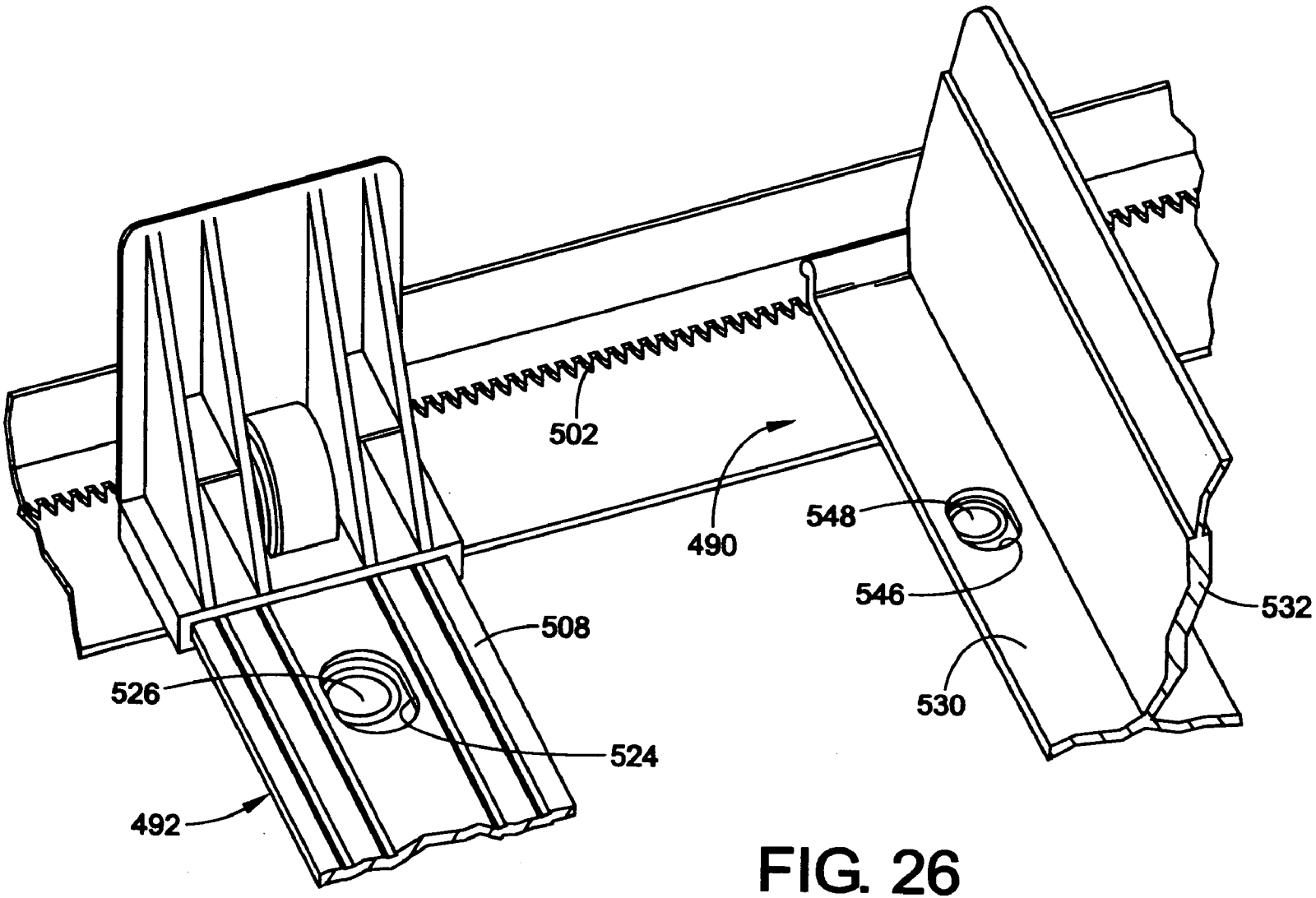
FIG. 26 is an enlarged rear perspective view of a portion of the merchandising system of FIG. 25.

As in several previous embodiments, the base includes a pair of rails 518 for slidably mounting a pusher 520. FIG. 26 illustrates that an opening 524 can be located in the base 508. The opening enables finger access to a contact surface 526 of the engaging member 506 so that the engaging member can be retracted. Such retraction, against the bias of the biasing member 510 disengages the teeth 504 of the engaging member 506 from the teeth 502 of the rail. Once disengaged, the track 492 can be moved laterally, such as by sliding, in relation to the front rail 490. In this way, the track can be moved laterally without having to be unloaded. Put another way, the track can be laterally adjusted even though merchandise is supported on the track when the track is slid laterally. It should be appreciated that the track 492 cannot be pivoted in this embodiment.

Figure 28:
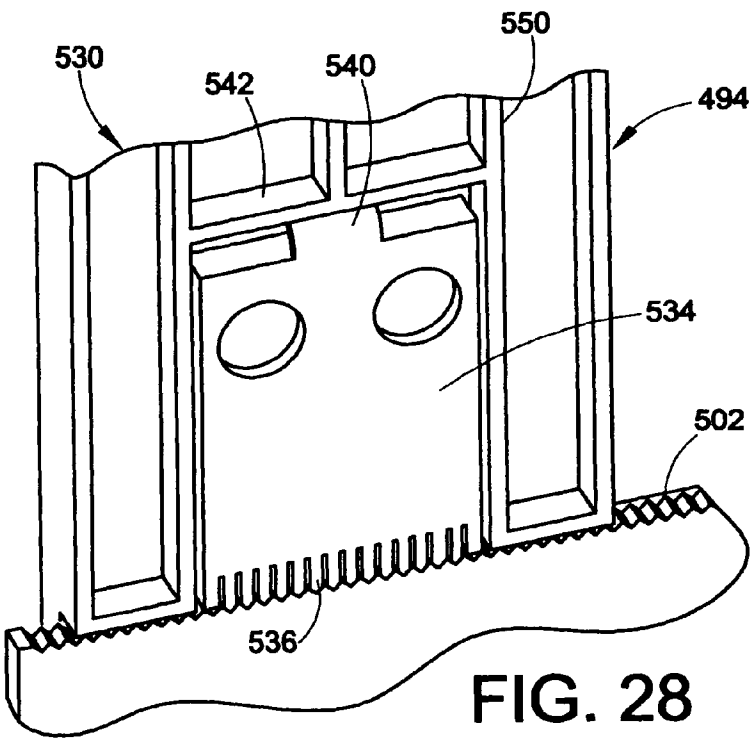
FIG. 28 is a broken away and enlarged view of a portion of the divider and front rail of FIG. 26 showing a locking engagement to prevent movement of the divider in relation to the front rail.

Also mounted on the front rail 490 is the divider 494. The divider includes a base portion 530, as well as an upstanding divider member 532. With reference now to FIG. 28, mounted to a bottom surface of the base 530 is an engaging member 534. The engaging member includes, on the front end, a set of teeth 536. These teeth selectively engage the teeth 502 of the front rail. The engaging member also includes a body portion. Located on a rear end of the engaging member is a biasing member 540. As with the biasing member of FIG. 27, the biasing member 540 urges the engaging member 534 forwardly so as to bring the teeth 536 thereof into engagement with the teeth 502 of the front rail. The biasing member 540 can rest against a cross bar 542 located on the base 530. In the embodiment illustrated in FIG. 26, a pair of apertures 546 are located in the base (only one of the apertures being visible in FIG. 26). Respective contact surfaces 548 are accessible from the top surface of the base 530. Thus, the divider 494 can be moved laterally in relation to the rail 490 and selectively locked in place. Such sliding movement takes place without any pivoting of the divider 494.

Figure 29:
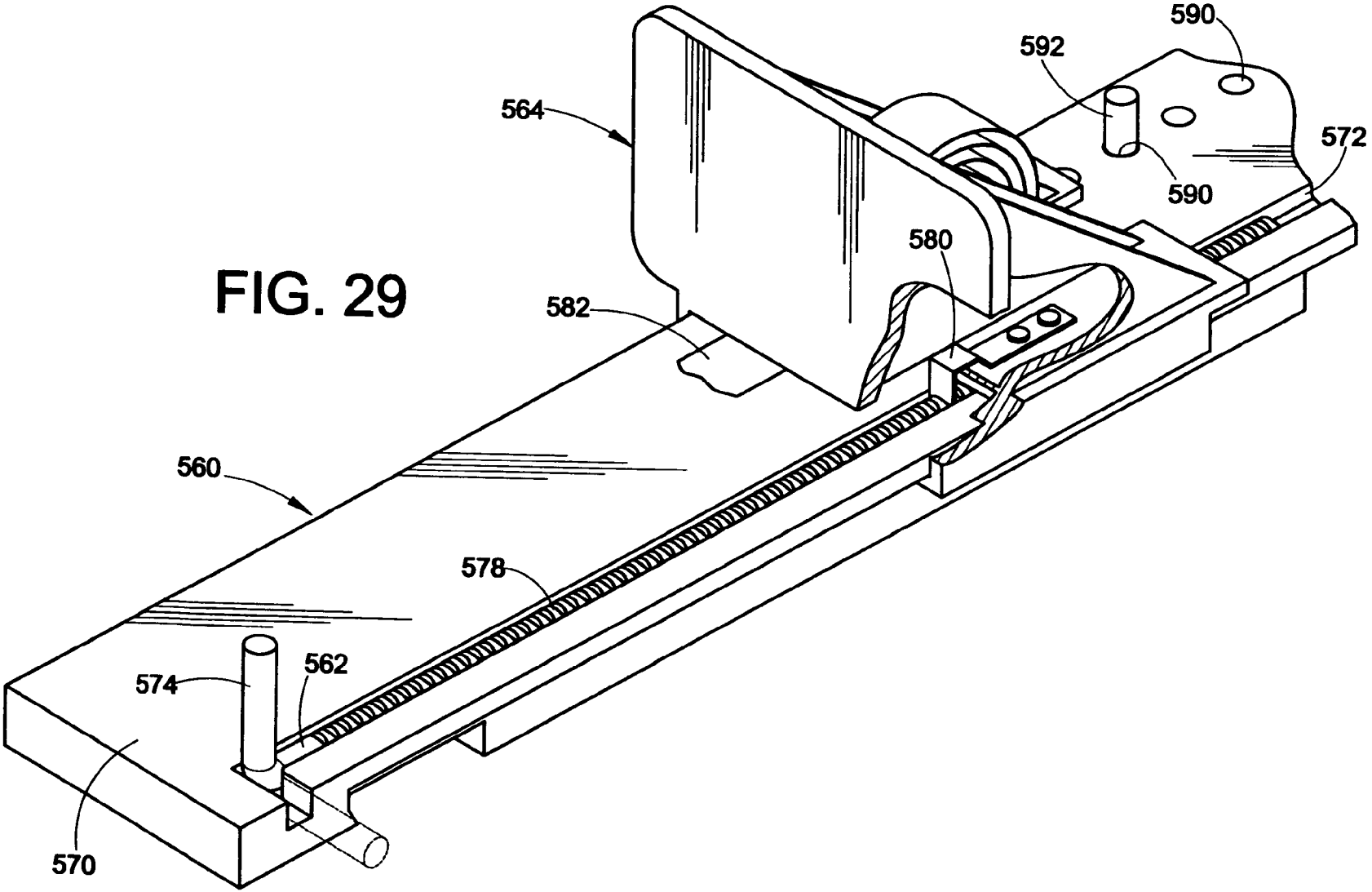
FIG. 29 is a perspective view of a sixth embodiment of a track according to the present disclosure.

With reference now to FIG. 29, another embodiment of a track is there illustrated. In this embodiment, a track 560 is provided with a blocking element 562 for selectively limiting the extent to which a pusher member 564 can be retracted on the track 560. In this embodiment, a base 570 of the track is provided with a longitudinally extending groove 572 for accommodating the blocking element 562. The blocking element 562 can be provided with a head portion 574 which extends at, for example, a right angle to a body portion 576 of the blocking element. Spaced along the body portion are a series of serrations 578. When the blocking element is located to the correct orientation, the serrations can be selectively engaged by a ratchet member 580. These two elements can be so designed as to only allow the pusher 564 to move in a forward direction as biased by a spring 582, but not allow a retraction of the pusher 564 along the track 560. However, when the blocking element is rotated by 90°, the serrations are no longer accessible to the ratchet member 580.

If desired, the pusher base 570 can be provided with one or more apertures 590, into a selected one of which a pin 592 can be placed. The purpose for the pin is to prevent the pusher 564 from being retracted past a given point along the length of the track 560. This would be advantageous in a merchandise setting where high value merchandise is being displayed on the track, and the merchant wishes to limit the number of items stored on the track at any given time. If there are only a few high value items located on the track, then pilferage of such high value items may be retarded, since a thief can only obtain a limited number of the high value items at any given time. In any case, only a limited number of such items would be lost.

Figure 30:
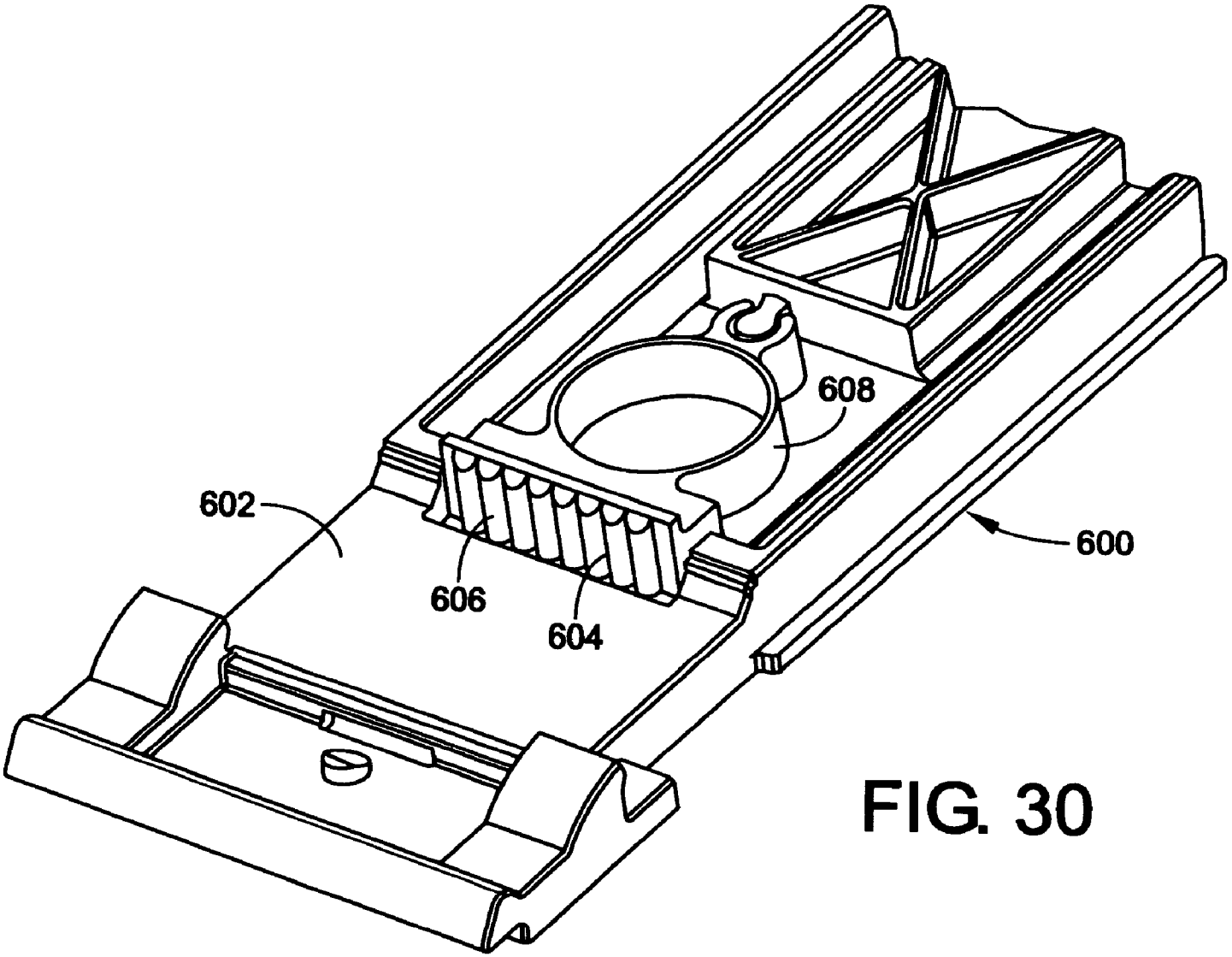
FIG. 30 is a perspective view of a seventh embodiment of a track according to the present disclosure.

With reference now to FIG. 30, a further embodiment of a track 600 according to the present disclosure includes a cross slot 602 and a cooperating member 604. It is evident that the cooperating member has a face with a plurality of protrusions 606 which extend into the slot 602. A resilient biasing member 608 urges the protrusion 606 into the slot 602. Thus, in this embodiment, a track is provided with an engaging element which is moveable in relation to the track. The engaging element selectively contacts the protrusions or teeth on the plateau of an elongated mounting member such as a front rail of the type discussed previously herein. In this way, a track can be selectively secured to such a rail so as to retard relative movement therebetween.

Figure 31:
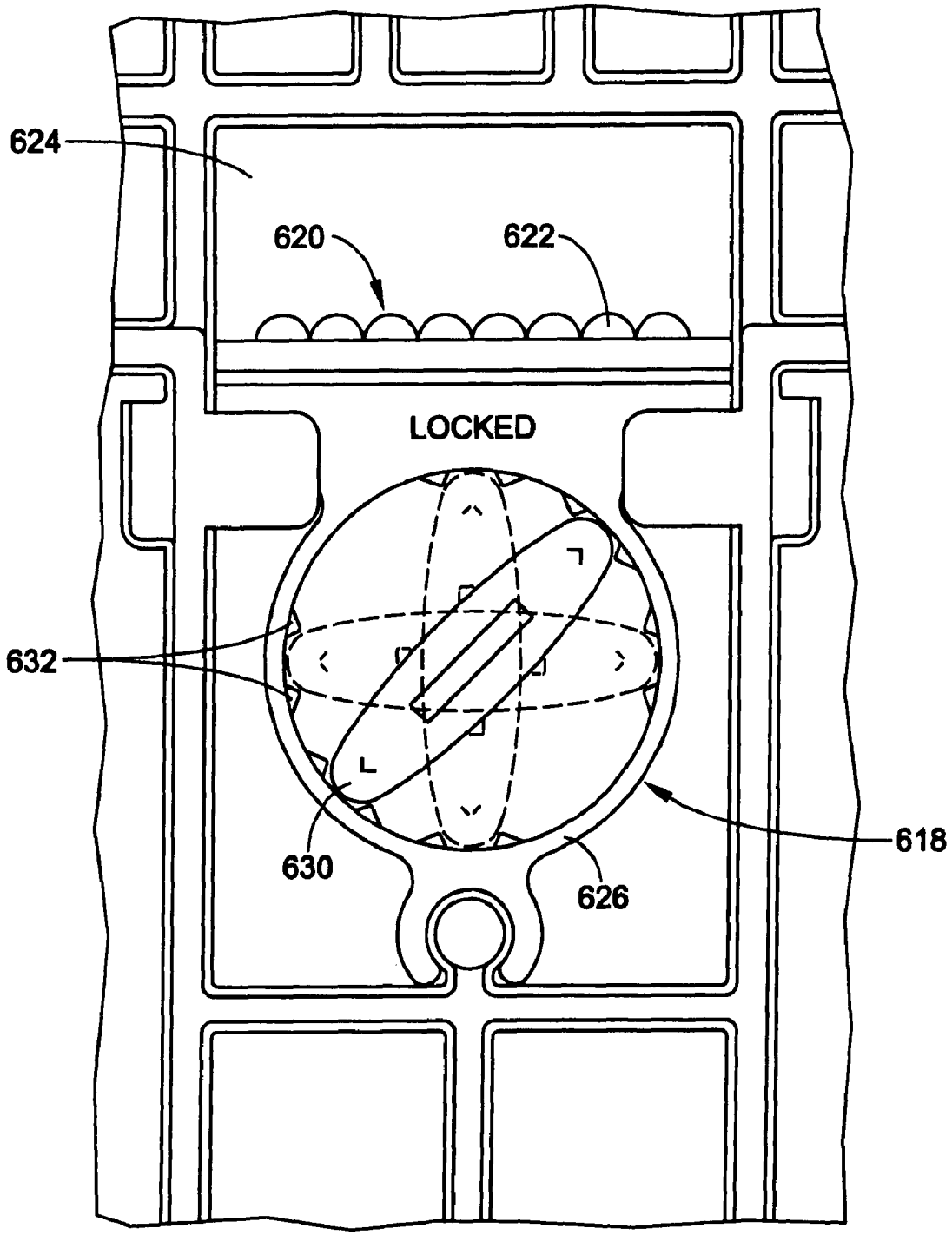
FIG. 31 is a bottom plan view of a cooperating member according to yet another embodiment of the present disclosure.

With reference now to FIG. 31, a cooperating member 618 can include an engaging element 620 with one or more protrusions 622 extending therefrom into a slot 624 defined in the cooperating member. The engaging element can be biased by a resilient biasing member such as at 626. In this embodiment, however, a limiting member 630 is provided. The limiting member selectively limits the resiliency of the biasing member and thus assists in holding engaging element in a desired condition. More particularly, the limiting member 630 is moveable between discrete positions. To this end, the biasing member 626 can be provided with small protrusions 632 in order to maintain the limiting member in a selected angular orientation. Three such orientations, spaced apart at 45° angles, are illustrated in FIG. 31. In a first orientation shown in solid lines, the biasing member is allowed to flex an intermediate amount. In a second, locked condition the limiting member is oriented approximately perpendicular to a face of the engaging element 620. In this orientation, the limiting member 630 prevents any flexing of the resilient member 626, thereby locking the cooperating member to the elongated mounting member. In a third orientation, in which the limiting member is oriented parallel to the face of the engaging element, the biasing member 626 is allowed to flex to its full extent, thereby providing a low or no ratchet condition for the engaging element in relation to the elongated mounting member. Thus, the amount of bias provided by the biasing element 626 can be controlled in order to selectively lock the cooperating member to the elongated mounting member. Alternatively, the engaging element can be simply resiliently biased into engagement with the elongated mounting member.

Figure 32:
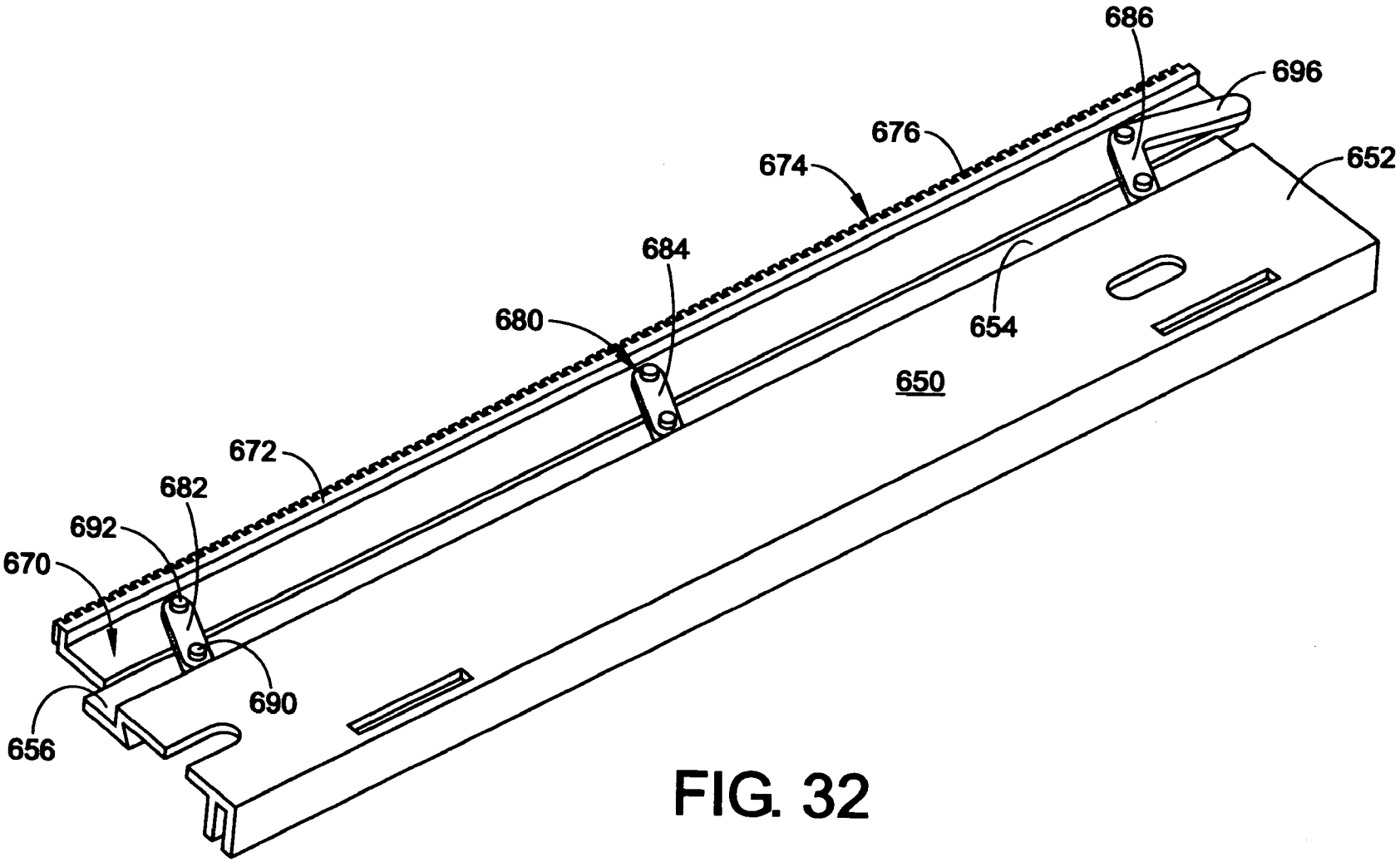
FIG. 32 is a bottom perspective view of the mounting member according to still another embodiment of the present disclosure, in a first position.
Figure 33:
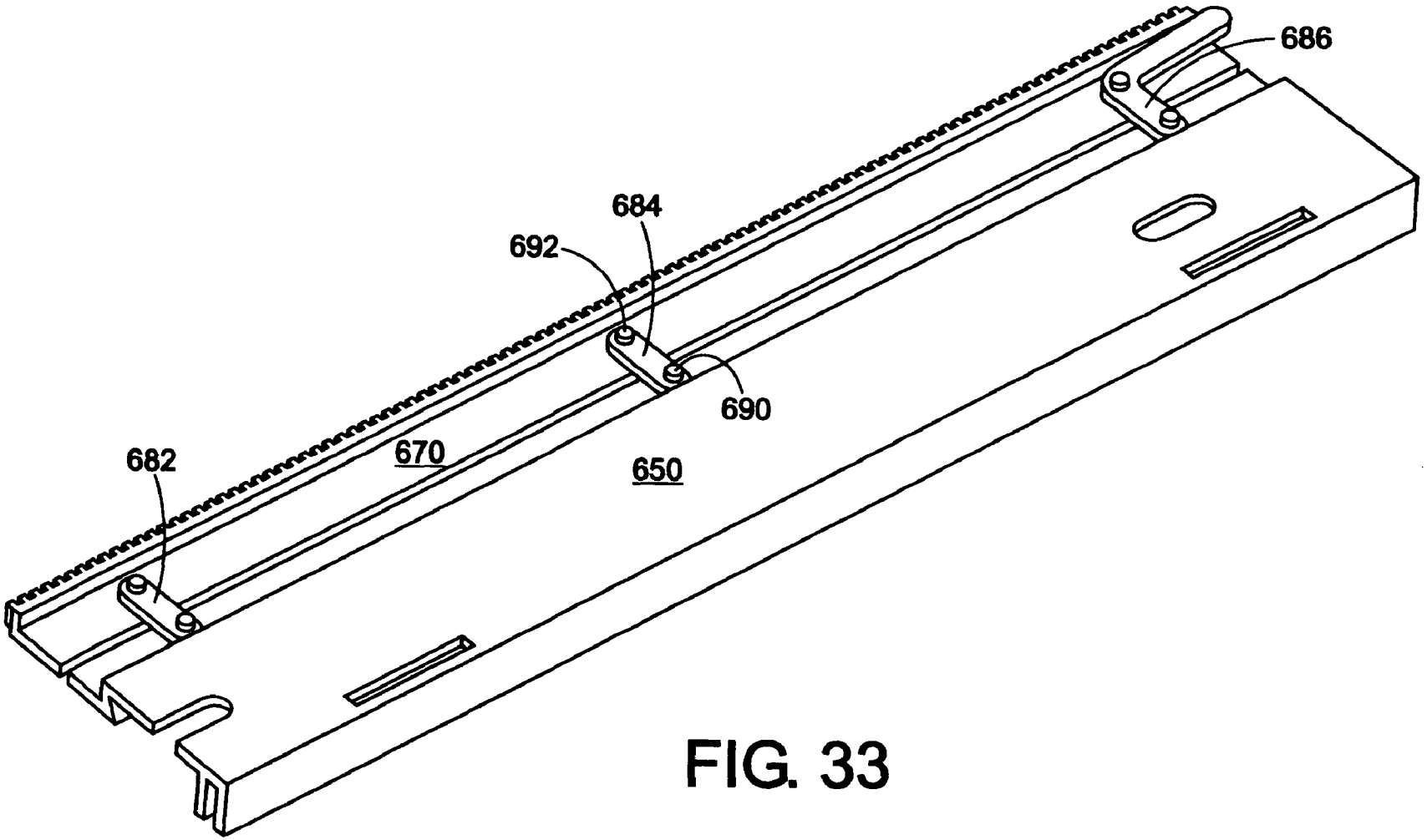
FIG. 33 is a bottom perspective view of the mounting member of FIG. 32 in a second position.

FIGS. 32 and 33 illustrate another embodiment of a mounting member according to the present disclosure. In this embodiment, the mounting member 650 includes a bottom surface 652. A channel 654 is defined in the bottom surface at the location of a plateau 656 defined on the mounting member. Also provided in this embodiment is an engaging element 670. The engaging element includes a top wall 672 and a rear wall 674. Defined on the rear wall are a plurality of protrusions 676. A connecting system 680 connects the engaging element 670 to the mounting member 650 in a moveable manner. More particularly, in this embodiment, the connecting system includes a first link 682, a second link 684 and a third link 686. In order to mount the links on the mounting member 650 and the engaging element 670, respective stubs 690 on the mounting member and 692 on the engaging element are provided. The links are able to rotate in relation to the stubs and, hence, allow a movement of the engaging element 670 in relation to the mounting member 650 as is evident from a comparison of FIGS. 32 and 33. In order to selectively move the engaging element 670 in relation to the mounting member 650, a handle portion 696 is provided on the third link 686. The handle portion is accessible from beneath the engaging element so that it can be manually moved by store personnel when that is considered desirable.

Figure 34:
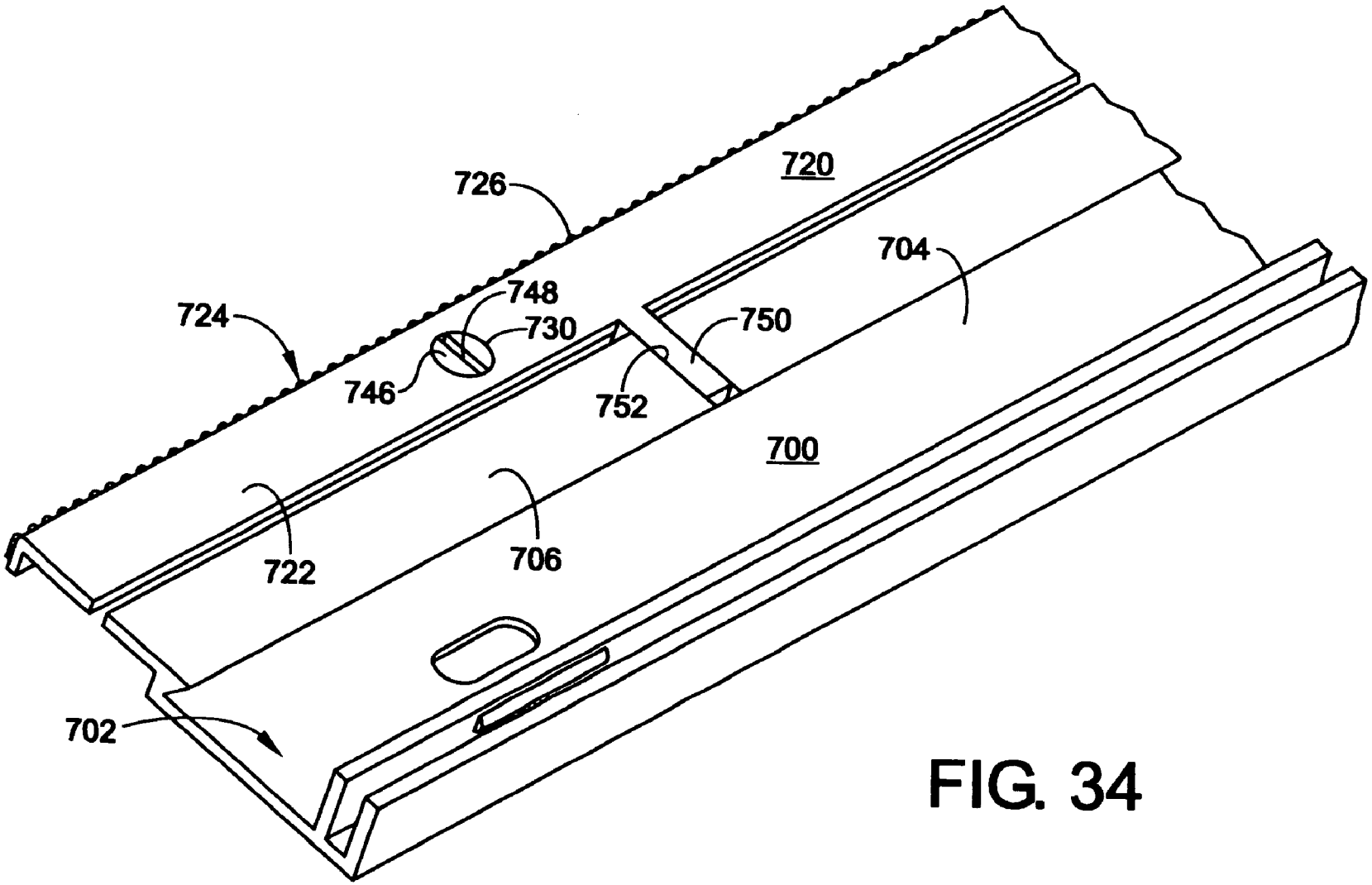
FIG. 34 is a top perspective view of a mounting member according to yet a further embodiment of the present disclosure in a first position; and, FIG. 35 is a bottom perspective view of the mounting member of FIG. 34.
Figure 35:
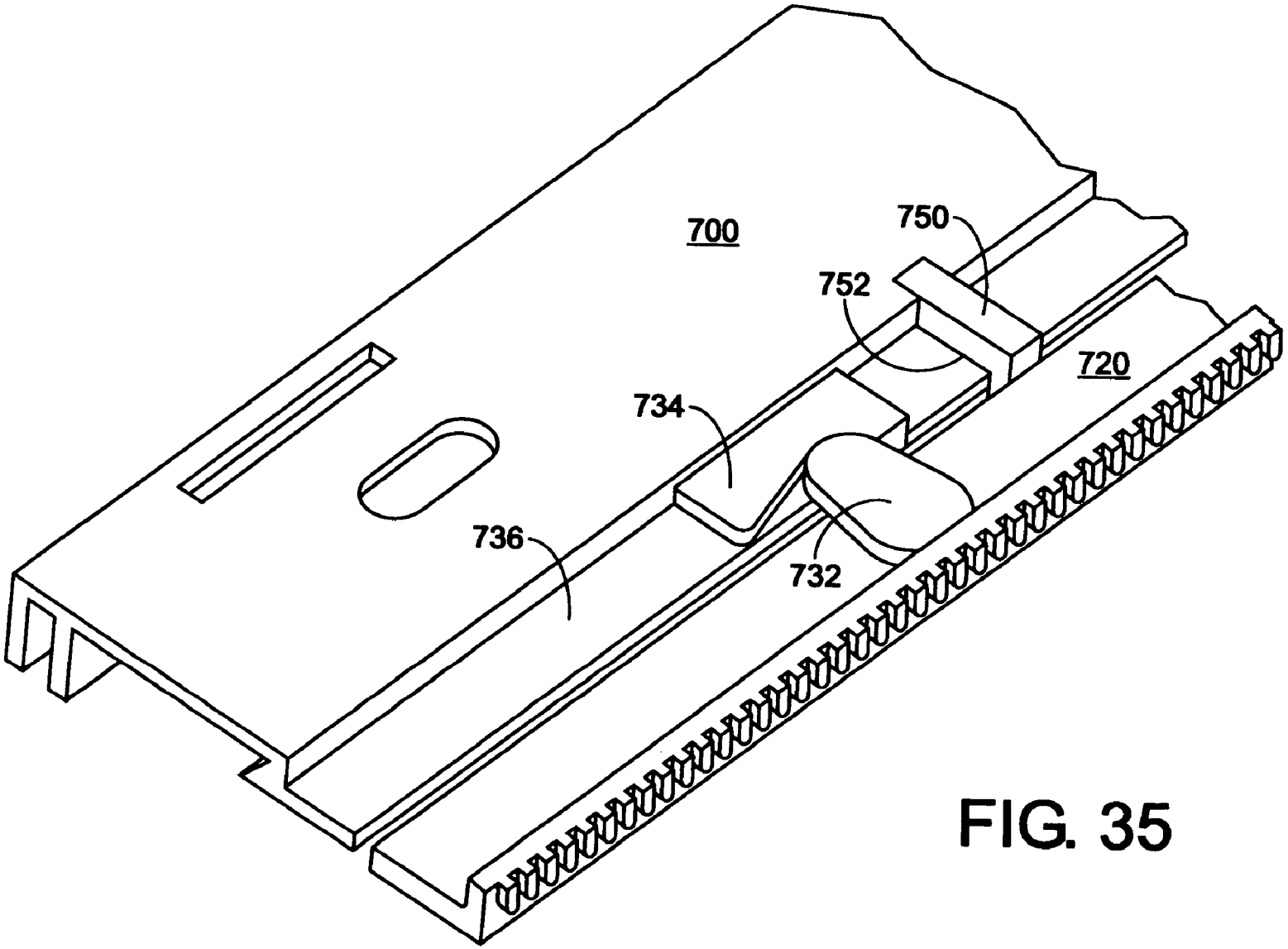

With reference now to FIGS. 34 and 35, still another version of a mounting member 700 is there illustrated. In this design, the mounting member includes a horizontal wall 702 in which is defined a channel 704 and a plateau section 706. Connected thereto is an engaging element 720. The engaging element includes a top wall 722 and a rear wall 724 on which there are defined a plurality of protrusions 726. A connecting system 730 connects the engaging element 720 to the mounting member 700. In this design, the connecting system 730 includes a cam 732 rotatably mounted on the engaging element and a cam surface 734 defined on the mounting member. More particularly, the cam surface 734 is defined on a bottom face 736 of the plateau section 706. With reference to FIG. 34, a knob 746 is accessible from a top side of the plateau 706 as it extends through an aperture 748 therein. A rotation of the knob 746 causes a rotation of the cam 732 against the cam surface 734 thereby moving the engaging element linearly forwards and backwards in relation to the mounting member 700. To ensure that such movement is substantially linear, the engaging element can be provided with one or more protrusions 750 which extend into slots 752 defined in the plateau 706 of the mounting member 700.

It is advantageous to have a means for selectively locking the cooperating member, i.e., a track, a divider or a combination track and divider, to a mounting member, such as a rail, in order to hinder the tendency for dividers to "walk" in relation to the mounting member when cylindrical items, such as cans or bottles, are pushed forward on a track.

Another benefit of the resilient engaging elements discussed herein is that they enable the cooperating member to sufficiently engage the mounting member with just the right amount of fit. Since the mounting members and the cooperating members are normally made from a thermoplastic material, there is some variation in tolerances which needs to be accommodated. The instant engaging element which is resiliently biased has benefit in that the cooperating member engages the mounting member in a way which is not too tight and not too loose. If the cooperating member is too loosely engaged on the mounting member due to tolerance variances, then the cooperating member can move too easily in relation to the mounting member. This has the disadvantages mentioned previously. On the other hand, if, due to tolerances, the mounting member is too tightly engaged with the cooperating member, then it will be difficult for store personnel to move the cooperating member in relation to the mounting member when that is desired. As a result of the resiliently biased engaging element which can be provided either on the cooperating member or the mounting member, these two members of the merchandising system can be mated to each other with the desired amount of contact so as to prevent unwanted movement between them while, at the same time, permitting desired movement.

While the elongated mounting member has been described as a front rail, it should be appreciated that the rail could be otherwise located on a shelf. For example, a rear rail could be employed instead of a front rail. Alternatively, both front and rear rails can be used, as shown in FIG. 25. Also, the engaging element of the cooperating member can have any desired shape so as to selectively secure the cooperating member to the mounting member. In other words, while protrusions and stems have been disclosed for contacting, cooperating with or engaging with teeth and apertures, respectively, other types of known cooperating surfaces could be employed instead.

The cooperating member has been illustrated as a divider in several figures (for example, FIGS. 14-18) and as a track in other figures (for example, FIGS. 3, 4, 11-13, 19, 24A and 29). In still other figures, the track and divider have been shown mounted on a mounting member in a side-by-side manner (see, for example, FIGS. 2, 22, 25 and 26) but spaced from each other. It should be, however, appreciated that the track and divider could be made integral with each other. On such design is shown in U.S. Pat. No. 7,216,770, the disclosure of which is incorporated hereinto, in its entirety.

The disclosure has been described with reference to several embodiments. Obviously, modifications and alterations will occur to others upon a reading and understanding of this specification. It is intended to include all such modifications and alterations in so far as they come within the scope of the appended claims or the equivalents thereof.

Having thus described the preferred embodiments, the invention is claimed as follows:

1. A merchandising system comprising:

an elongated mounting member selectively securable to an associated shelf, said mounting member including a first longitudinal axis, a front side edge extending generally parallel to the longitudinal axis and a rear side edge extending generally parallel to the longitudinal axis;

a cooperating member received on the mounting member and extending beyond a only the rear side edge of the mounting member whereby the cooperating member extends rearwardly over the associated shelf, said cooperating member comprising an elongated body which includes a second longitudinal axis, said second longitudinal axis being oriented generally transverse to said first longitudinal axis such that a plurality of cooperating members can be selectively received on the mounting member; and an engaging element movably mounted to one of said cooperating member and said mounting member, said engaging element movable to selectively contact the other of said mounting member and said cooperating member in order to selectively retard relative movement between said cooperating member and said mounting member.

2. The merchandising system of claim 1 wherein said cooperating member comprises at least one of a divider and a track.

3. The merchandising system of claim 1 further comprising a biasing element connected to said engaging element for urging said engaging element to one end position.

4. The merchandising system of claim 3 further comprising a holding member contacting said engaging element for selectively holding said engaging element in a desired condition.

5. The merchandising system of claim 1 wherein said engaging element comprises a face and at least one protrusion extending from said face, said at least one protrusion selectively contacting a portion of said elongated mounting member.

6. The merchandising system of claim 5 wherein said mounting member comprises a plurality of protrusions located on a wall of said mounting member, said protrusions cooperating with said at least one protrusion of said engaging element.

7. The merchandising system of claim 5 further comprising a biasing member connected to said engaging element for biasing said engaging element at least one protrusion into contact with said elongated mounting member.

8. The merchandising system of claim 5 wherein said engaging element further comprises:

a contact surface that can be accessed by a person's digit in order to move said engaging element from a first position to a second position.

9. The merchandising system of claim 1 wherein said plurality of cooperating members comprises at least two cooperating members which are spaced from each other.

10. The merchandising system of claim 1 wherein said engaging element comprises at least one of a tooth and a locking element.

11. The merchandising system of claim 1 wherein said engaging element comprises a plurality of spaced teeth.

12. A merchandising system comprising:

an elongated mounting member selectively securable to an associated shelf, said mounting member including a first longitudinal axis;

a cooperating member received on the mounting member, wherein the cooperating member extends rearwardly over the associated shelf, said cooperating member comprising an elongated body which includes a second longitudinal axis, said second longitudinal axis being oriented generally transverse to said first longitudinal axis such that a plurality of cooperating members can be selectively received on the mounting member;

an engaging element movably mounted to one of said cooperating member and said mounting member, said engaging element movable to selectively contact the other of said mounting member and said cooperating member in order to selectively retard relative movement between said cooperating member and said mounting member; and a connecting system for connecting said engaging element to said one of said cooperating member and said mounting member to allow movement of said engaging element relative to said one of said cooperating member and said mounting member;

wherein said connecting system comprises a plurality of links, one of said links including a handle.

* * * * *